US007556049B2

(12) United States Patent
Oakes et al.

(10) Patent No.: US 7,556,049 B2
(45) Date of Patent: Jul. 7, 2009

(54) DISHWASHER MODULAR EXHAUST VENT

(75) Inventors: Michelle L Oakes, Holland, MI (US); Marc R Pendergrass, Berrien Springs, MI (US); Angela J Robbins, Stevensville, MI (US); Andrew J Retsema, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 508 days.

(21) Appl. No.: 10/978,857

(22) Filed: Nov. 1, 2004

(65) Prior Publication Data

US 2006/0090778 A1 May 4, 2006

(51) Int. Cl.
*A47L 15/48* (2006.01)
*B08B 3/00* (2006.01)

(52) U.S. Cl. ..... 134/58 D; 134/183; 134/200; 134/201; 34/235

(58) Field of Classification Search ..... 134/58 D, 134/56 D, 57 D, 182, 183, 200, 201; 34/235
See application file for complete search history.

(56) References Cited

U.S. PATENT DOCUMENTS

| | | | | |
|---|---|---|---|---|
| 2,707,961 | A | 5/1955 | Geiger et al. | |
| 3,398,756 | A | 8/1968 | Kauffman et al. | |
| 3,876,469 | A * | 4/1975 | Schimke | 134/95.2 |
| 4,182,351 | A | 1/1980 | Deaton et al. | 134/58 |
| 4,184,500 | A | 1/1980 | Herbst | 134/114 |
| 4,188,732 | A * | 2/1980 | Quayle | 34/570 |
| 4,247,158 | A | 1/1981 | Quayle | 312/213 |
| 5,167,248 | A | 12/1992 | Tuller | 137/1 |
| 5,195,190 | A * | 3/1993 | Nguyen-Huu | 4/378 |
| 5,409,144 | A * | 4/1995 | Brown | 222/185.1 |
| 5,572,869 | A | 11/1996 | Schantz et al. | 60/528 |
| 5,636,324 | A * | 6/1997 | Teh et al. | 704/226 |
| 5,660,195 | A * | 8/1997 | Taylor et al. | 134/58 D |
| 5,829,459 | A | 11/1998 | Milocco et al. | 134/57 |
| 5,836,324 | A * | 11/1998 | Johnson et al. | 134/58 D |
| 5,881,746 | A | 3/1999 | Buser et al. | 134/58 |
| 6,293,289 | B1 | 9/2001 | Hapke et al. | 134/58 |

FOREIGN PATENT DOCUMENTS

AU PO 5482/97 * 7/1997

* cited by examiner

*Primary Examiner*—Joseph L Perrin
(74) *Attorney, Agent, or Firm*—John Morrison; Michael D. Lafrenz

(57) ABSTRACT

A modular exhaust vent for use in venting a wash chamber of a dishwasher, such as during a dry cycle, comprises a housing that forms an exhaust flow path from the wash chamber to the exterior of the dishwasher and a valve operable for pivotal movement about a pivot axis between an opened and closed position for selectively closing the exhaust flow path. An actuator for moving the valve is connected to the valve by a link such that activation of the actuator effects movement of the link to pivot the valve to either the opened or closed position. Further, the valve selectively closes the exhaust flow path at an inlet to impede introduction of sound into the exhaust flow path.

32 Claims, 22 Drawing Sheets

DISHWASHER MODULAR EXHAUST VENT

BACKGROUND OF THE INVENTION

1. Field of the Invention

The invention relates to a dishwasher vent. In one aspect, the invention relates to a modular exhaust vent for use in a dishwasher. In another aspect, the invention relates to a dishwasher having a modular exhaust vent.

2. Description of the Related Art

Household dishwashers for cleaning dishes, such as plates, bowls, utensils, glasses, barware, pots, pans, and the like, typically comprise an open-face cabinet with a wash chamber for holding the dishes and a door for selectively closing the open-face cabinet. During use, dishwashers usually operate according to a preprogrammed cycle having various operating parameters selected according to the type of dishes being washed. Most of the cycles comprise a wash cycle followed by a dry cycle. During the wash cycle, liquid and wash aids are introduced into the wash chamber, and a liquid distribution system recirculates the liquid and wash aids according to the parameters of the wash cycle. After the wash cycle, which can include a rinse cycle, the dishes are dried during the dry cycle.

In the dry cycle, after the liquid and wash aids are drained from the wash chamber, a heating element is energized to heat the interior of the wash chamber. Heated, moisture-laden air travels upward within the wash chamber due to convection and exits the wash chamber through an exhaust vent, which is usually located in an upper portion of the door. In some configurations, a blower is provided to force air into the wash chamber and out the exhaust vent to increase the drying speed.

Typically, the exhaust vent comprises a valve that closes during the wash cycle and opens during the drying cycle or during a build-up of pressure in the wash chamber. The vent is usually positioned in a duct that leads from an inside surface of the door (i.e., the side facing the wash chamber when the door is closed) to the outside surface of the door (i.e., the side facing the exterior of the dishwasher when the door is closed) such that spaces are formed within the duct upstream and downstream of the vent. While the exhaust vent is very useful during the drying cycle, its presence can increase the noise emitted into the surrounding environment. For example, during the wash cycle, the sprayed wash liquid impinges on the interior of the wash chamber and thereby generates noise that can escape the otherwise sealed wash chamber through the exhaust vent. Noise at specific frequencies can enter the upstream space in the duct and resonate in the space and to the exterior of the dishwasher. Noisy dishwashers can be extremely annoying and are the source of many consumer complaints. Thus, it is desirable to have an exhaust vent that opens during a dry cycle to vent air from the wash chamber but closes during a wash cycle and prevents transmission of noise to the exterior of the dishwasher.

SUMMARY OF THE INVENTION

A dishwasher according to the invention comprises an open-face cabinet defining a wash chamber; a door movably mounted to the cabinet for movement between an opened and closed condition to selectively close the open-face cabinet; and a modular exhaust vent. The modular exhaust vent comprises a housing defining a conduit having an inlet and an outlet, the inlet open to the wash chamber, and the outlet open to the exterior of dishwasher to form an exhaust flow path from the wash chamber to the exterior of the dishwasher; a valve operable for pivotal movement about a pivot axis between an opened and closed position for selectively closing the exhaust flow path; an actuator; and a link connecting the actuator to the valve. Activation of the actuator effects movement of the link to move the valve to one of the opened and closed positions.

The conduit can comprise a valve seat, and the valve can comprise a valve body that abuts the valve seat when the valve is in the closed position. The valve body can be a resilient disk. The valve seat can be at the conduit inlet. The valve body can be carried by a frame having a hinge that defines the pivot axis.

The link can comprise a lever arm having a longitudinal axis transverse to the pivot axis. The hinge can be coupled to the lever arm. The actuator can comprise a shaft operably mounted to the lever arm and movable between an inactive position and an active position for pivoting the lever arm about the pivot axis and moving the valve between the opened and closed positions.

The valve can be normally biased to the opened position. The modular exhaust vent can be mounted to the door.

A modular exhaust vent according to the invention for use in a dishwasher comprising an open-face cabinet defining a wash chamber and a door moveably mounted to the cabinet for movement between an opened and closed condition to selectively close the open-face cabinet comprises a housing defining a conduit having an inlet and an outlet, the inlet open to the wash chamber, and the outlet open to the exterior of dishwasher to form an exhaust flow path from the wash chamber to the exterior of the dishwasher; a valve operable for pivotal movement about a pivot axis between an opened and closed position for selectively closing the exhaust flow path; an actuator; and a link connecting the actuator to the valve. Activation of the actuator effects movement of the link to move the valve to one of the opened and closed positions.

The conduit can comprise a valve seat, and the valve can comprise a valve body that abuts the valve seat when the valve is in the closed position. The valve body can be a resilient disk. The valve seat can be at the conduit inlet. The valve body can be carried by a frame having a hinge that defines the pivot axis.

The link can comprise a lever arm having a longitudinal axis transverse to the pivot axis. The hinge can be coupled to the lever arm. The actuator can comprise a shaft operably mounted to the lever arm and movable between an inactive position and an active position for pivoting the lever arm about the pivot axis and moving the valve between the opened and closed positions.

The valve can be normally biased to the opened position. The modular exhaust vent can be mounted to the door.

A dishwasher according to the invention comprises an open-face cabinet defining a wash chamber; a door movably mounted to the cabinet for movement between an opened condition and a closed condition to selectively close the open-face cabinet and comprising an interior wall that faces the wash chamber when the door is in the closed condition; and a modular exhaust vent comprising: a housing mounted to the door and defining a conduit having an inlet and an outlet, the inlet opening to the wash chamber, and the outlet opening to the exterior of dishwasher to form an exhaust flow path from the wash chamber to the exterior of the dishwasher; and a valve operable between an opened and closed position for selectively closing the conduit at the inlet to impede introduction of sound into the conduit.

The door can comprise an opening in the interior wall, and the inlet can be generally coincident with the interior wall of the door so that the valve in the closed position is adjacent to the opening of the interior wall.

The conduit can comprises a valve seat at the inlet, and the valve can comprises a valve body that abuts the valve seat when the valve is in the closed position. The modular exhaust vent can further comprise an inlet cover that overlies the inlet opening and forms the valve seat. The inlet cover can comprise a bezel that forms the valve seat. At least a portion of the inlet cover can overlie the interior wall. The valve body can be a resilient disk. At least a portion of the inlet cover can project into the conduit so that the valve seat resides in the conduit near the inlet.

The valve can be operable for pivotal movement about a pivot axis between the opened and the closed positions. The modular exhaust vent can further comprise: an actuator; and a link connecting the actuator to the valve; wherein activation of the actuator effects movement of the link to move the valve to one of the opened and closed positions. The valve can be carried by a frame having a hinge that defines the pivot axis. The link can comprise a lever arm having a longitudinal axis transverse to the pivot axis.

In a dishwasher comprising an open-face cabinet defining a wash chamber; and a door movably mounted to the cabinet for movement between an opened condition and a closed condition to selectively close the open-face cabinet and comprising an interior wall that faces the wash chamber when the door is in the closed condition; a modular exhaust vent according to the invention comprises a housing mounted to the door and defining a conduit having an inlet and an outlet, the inlet opening to the wash chamber, and the outlet opening to the exterior of dishwasher to form an exhaust flow path from the wash chamber to the exterior of the dishwasher; and a valve operable between an opened and closed position for selectively closing the conduit at the inlet to impede introduction of sound into the conduit.

The door can comprise an opening in the interior wall, and the inlet can be generally coincident with the interior wall of the door so that the valve in the closed position is adjacent to the opening.

The conduit can comprise a valve seat at the inlet, and the valve can comprise a valve body that abuts the valve seat when the valve is in the closed position. The modular exhaust vent can further comprise an inlet cover that overlies the inlet opening and forms the valve seat. The inlet cover can comprise a bezel that forms the valve seat. At least a portion of the inlet cover can overlie the interior wall. The valve body can be a resilient disk. At least a portion of the inlet cover can project into the conduit so that the valve seat resides in the conduit near the inlet.

The valve can be operable for pivotal movement about a pivot axis between the opened and the closed positions. The modular exhaust vent can further comprise: an actuator; and a link connecting the actuator to the valve; wherein activation of the actuator effects movement of the link to move the valve to one of the opened and closed positions. The valve can be carried by a frame having a hinge that defines the pivot axis. The link can comprise a lever arm having a longitudinal axis transverse to the pivot axis.

DESCRIPTION OF THE INVENTION

Figure 1:
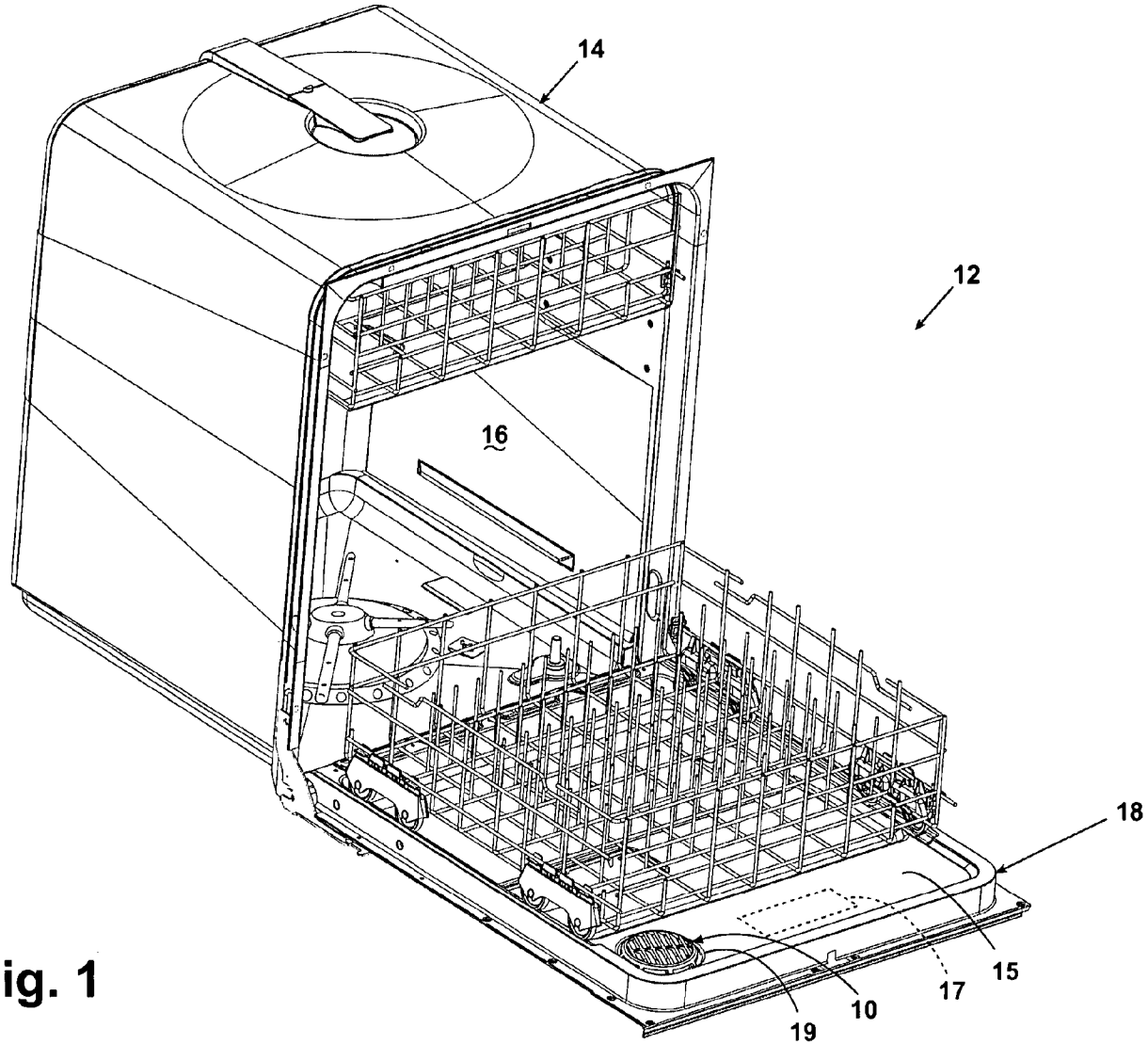
FIG. 1 is a perspective view of a dishwasher with a modular exhaust vent according to the invention.
Figure 2:
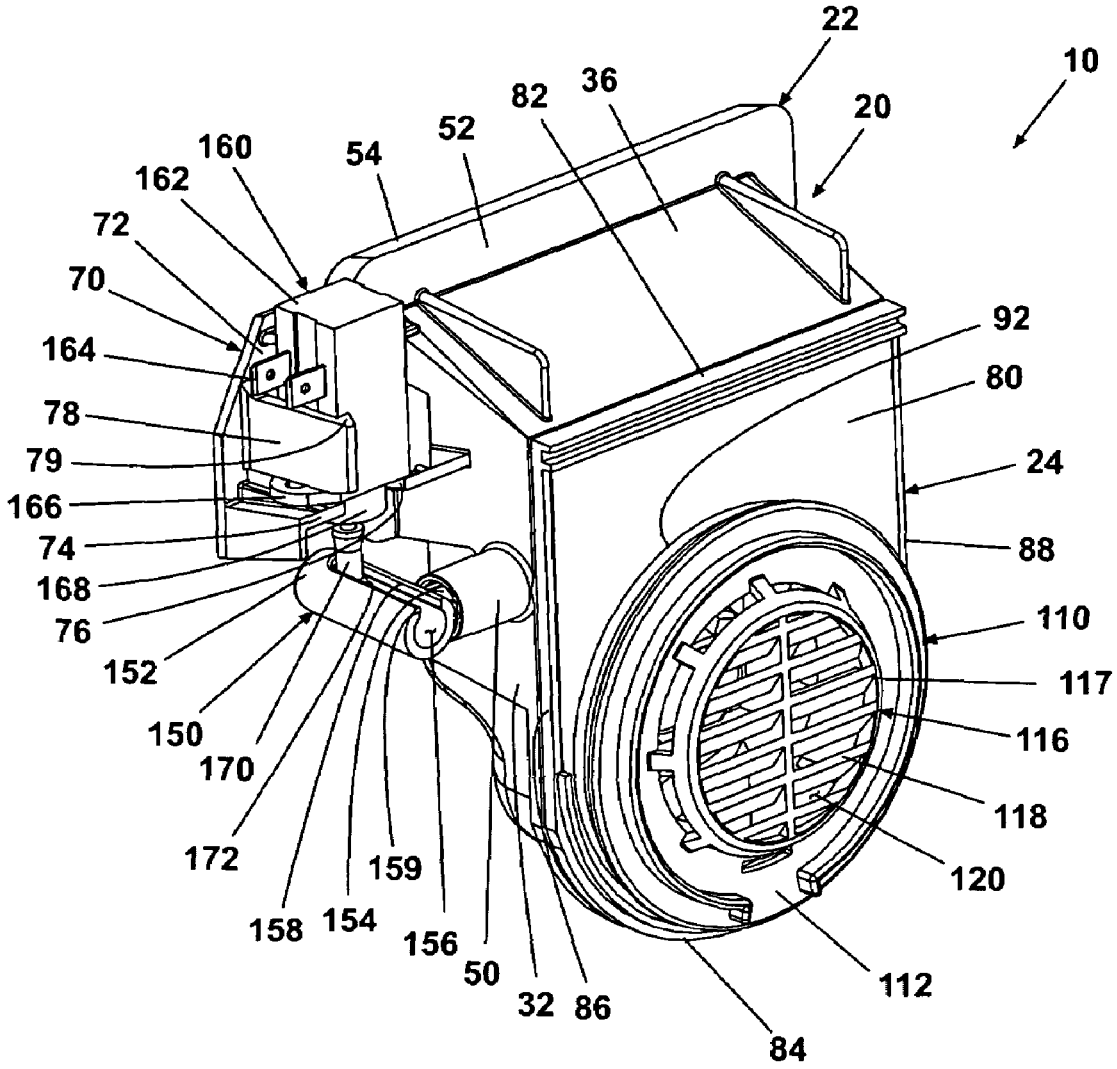
FIG. 2 is a front perspective view of the modular exhaust vent of FIG. 1.

Referring now to the figures and particularly to FIG. 1, a conventional household dishwasher 12 for cleaning dishes, such as plates, bowls, utensils, glasses, barware, pots, pans, and the like, comprises an open-face cabinet 14 that defines a wash chamber 16 and a door 18 for selectively closing the cabinet 14 and, thus, wall the wash chamber 16. The door 18 is movable from an opened position, as shown in FIG. 1, wherein the wash chamber 16 is accessible to a user, and a closed position, wherein the door 18 abuts the cabinet 14 so that the cabinet 14 and the door 18 enclose the wash chamber 16. The door 18 comprises a generally hollow cavity formed between an interior wall 15 and an exterior wall (not shown) and supports various components, such as one or more wash aid dispensers (not shown) and a control system 17 for controlling the dishwasher 12 and executing preprogrammed wash cycles and dry cycles. The interior wall 15 includes an opening 19, which is preferably located at an upper portion of the door 18 (when the door 18 is in the closed position), for exhausting air from the wash chamber 16 during a dry cycle. The dishwasher 12 further comprises a modular exhaust vent 10 according to the invention mounted to the door 18 and preferably mounted within the door 18 such that the exhaust vent 10 is in fluid communication with the opening 19.

Referring now to FIGS. 2-5B, the modular exhaust vent 10 comprises a housing 20 that defines a conduit, a valve 130 mounted within the conduit in the housing 20, an actuator 160 supported on the housing 20 for operating the valve 130, and a link 150 that connects the actuator 160 to the valve 130. Movement of the valve 130 by the actuator 160 opens and closes an exhaust flow path 41 (FIG. 7) formed by the conduit for selectively venting air from the wash chamber 16.

The housing 20 comprises a housing body 22 having a rear wall 30, opposing first and second side walls 32, 34, an inclined top wall 36, and a curved bottom wall 38, which together define a chamber 40, which forms part of the exhaust flow path 41. The chamber 40 is closed by a housing cover 24 that functions as a front wall for the housing 20. Depending upper and lower flanges 42, 44 extend from the top and bottom walls 36, 38, respectively, to facilitate mounting the housing cover 24 to the housing body 22. The first and second side walls 32, 34, include generally horizontal indentations 46 that form laterally aligned U-shaped grooves 48.

Additionally, the housing body 22 comprises an outwardly protruding cylindrical, hollow projection 50 that is substantially orthogonal to the first side wall 32 and aligned with the grooves 48. The housing body 22 further includes a generally U-shaped rear flange 52 that surrounds an upper portion of the first and second side walls 32, 34 and the top wall 36 and includes rearwardly extending and generally rectangular outer and inner rims 54, 56. The rear flange 52 and the outer and inner rims 54, 56 form a rectangular channel 58 sized to receive a seal 62, and the inner rim 56 defines an outlet 60 for the conduit. An actuator support 70 formed integrally with the rear flange 52 and the first side wall 32 comprises a rear wall 72 in the same plane as the rear flange 52, an inclined bottom wall 74 having an arcuate groove 76, and a pair of braces 78 that project forward from the rear wall 72 and are spaced from the bottom wall 74. The braces 78 include opposing detents 79 that retain the actuator 160 between the braces 78 when the actuator 160 is mounted to the actuator support 70.

The housing cover 24 that forms the front wall of the housing 20 comprises a generally flat panel 80 having a horizontal upper edge 82, a curved lower edge 84, and opposing first and second side edges 86, 88. When the housing cover 24 abuts the housing body 22, the upper edge 82 abuts the upper flange 42, and the lower edge 84 abuts the lower flange 44. Two circular flanges, an inner flange 90 and an outer flange 92, on the panel 80 form a recess 91 therebetween sized to receive a seal 102, and the inner flange 90 defines an inlet 100 for the conduit. The housing cover 24 also includes circumferentially spaced detents 94 that project radially inward from the inner flange 90 for removably mounting an inlet cover 110 thereto.

The inlet cover 110 is a generally circular member with an annular body 112 and a circular wall 116 generally perpendicular to the annular body 112 and having a forward portion 117 on one side of the annular body 112 and a rearward portion 114 on an opposite side of the annular body 112. The forward portion 117 surrounds a plurality of louvers 118, which define a plurality of apertures 120, while the rearward portion 114 terminates at a bezel 115 and includes circumferentially spaced detents 122 extending radially outward from the circular wall 116 and sized for receipt between the detents 94 of the housing cover 24. The bezel 115 on the rearward portion 114 of the circular wall 116 functions as a valve seat for the valve 130.

The valve 130, which is mounted inside the housing 20, comprises a frame 132 that carries or supports a resilient, flexible annular valve disk or body 148 having an inner perimeter 147 and an outer perimeter 149. The frame 132 has a hinge 134 with a first end 136 and a second end 138 sized for receipt within the grooves 48 on the first and second side walls 32, 34 of the housing body 22. The first end 136 of the hinge 134 is generally cylindrical and hollow and includes a key 137 that extends axially along the interior of the hinge 134. The hinge 134 defines a pivot axis X and is joined to a valve body support 142 by a generally V-shaped connector 140. The valve body support 142 comprises a circular body 144 and two sets of circumferentially spaced and offset radial fingers 146. The sets of fingers 146 are spaced from one another a distance sufficient to receive and retain the valve body 148 therebetween. In particular, the inner perimeter 147 of the valve body 148 is situated between the sets of the fingers 146 and adjacent the circular body 144, while the outer perimeter 149 extends radially outward beyond the sets of fingers 146.

The actuator 160 for operating the valve 130 is preferably a conventional push-style wax motor comprising a generally rectangular motor body 162 with an electrical connection 164 for coupling the actuator 160 to a source of power. At one end of the motor body 162, side flanges 166 project from opposite sides thereof to facilitate mounting the actuator 160 to the actuator support 70. The actuator 160 further includes a nipple 168 that surrounds a movable shaft 170 having a terminal ball 172. The shaft 170 is movable between an inactive position, wherein the shaft 170 is retracted towards the motor body 162, and an active position, wherein the shaft 170 is displaced in a direction away from the motor body 162.

The actuator 160 is coupled to the valve 130 by the link 150, which comprises a cylindrical, tubular lever arm 152 and an extension 154 integral with and generally orthogonal to the arm 152. The arm 152 has a hollow interior 156 along a longitudinal axis Y and includes an axial slot 158 with a slot inlet 159 at one end thereof. The diameter of the hollow interior 156 is greater than that of the terminal ball 172, while width of the slot 158 is less than the diameter of the terminal ball 172 but greater than the diameter of the shaft 170. The extension 154 has an axial channel 155 formed therein and sized to mate with the key 137 on the hinge 134 of the frame 132 that carries the valve body 148.

An exemplary description of the assembly of the modular exhaust vent 10 follows. It will be apparent to one of ordinary skill that the operation can proceed in any logical order and is not limited to the sequence presented below. The following description is for illustrative purposes only and is not intended to limit the invention in any way.

To assemble the modular exhaust vent 10, the valve body 148 is attached the frame 132 by inserting the inner perimeter 147 between the sets of fingers 146 so that the outer perimeter 149 extends radially outward beyond the fingers 146. Next, the valve 130 is mounted to the housing body 22 by sliding the first and second ends 136, 138 of the hinge 134 into the grooves 48 in the first and second side walls 32, 34, respectively. The hinge 134 can rotate within the grooves 48 so that the valve 130 can pivot within the chamber 40.

After the valve 130 is properly positioned, the housing cover 24 is attached to the housing body 22 to enclose the chamber 40. To mount the housing cover 24 to the housing body 22, the upper and lower edges 82, 84 of the housing cover 24 are aligned with the upper and lower flanges 42, 44 of the housing body 22, and the housing cover 24 and the housing body 22 are joined by an adhesive, a conventional joining process, mechanical fasteners, or other suitable joining methods. When the housing cover 24 is mounted to the housing body 22, the housing 20 defines the conduit, which extends from the inlet 100, through the chamber 40, and to the outlet 60.

After the the housing cover 24 is mounted to the housing body 22, the extension 154 of the link 150 is inserted into the hollow projection 50 and into the open first end 136 of the hinge 134 so that the key 137 on the hinge 134 mates with the channel 155 on the extension 154. As a result, the longitudinal axis Y of the arm 152 is generally perpendicular to the pivot axis X defined by the hinge 132. Next, the actuator 160 is simultaneously mounted to the actuator support 70 and to the link 150. The terminal ball 172 is inserted into interior 156 of the arm 152 at the slot inlet 159 such that the shaft 170 extends upward through the slot 158. The actuator 160 is then slid rearward (i.e., the shaft 170 slides rearward along the slot 158) until the motor body 162 abuts the braces 78. The actuator 160 is then pushed onto the actuator support 70 so that the nipple 168 is received by the groove 76 in the bottom wall 74, the side flanges 166 are positioned between the bottom wall 74 and the braces 78, and the motor body 62 is situated between the braces 78 and held in place by the detents 79. Finally, the seal 62 is inserted into the channel 58 around the outlet 60 of the housing 20.

Figure 7:
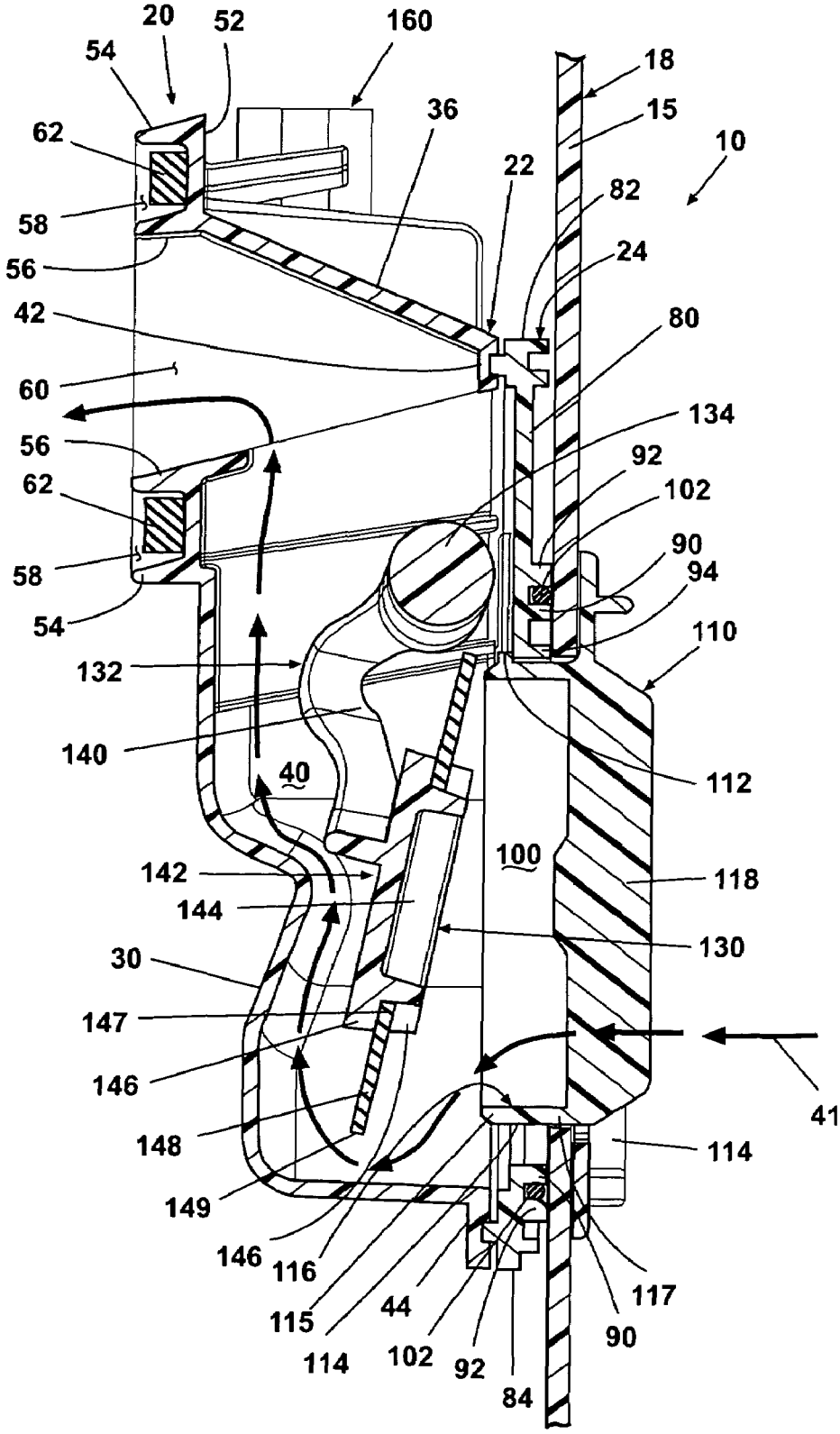
FIG. 7 is a sectional view taken along line 7-7 of FIG. 6, with the inlet cover mounted to the modular exhaust vent.
Figure 9:
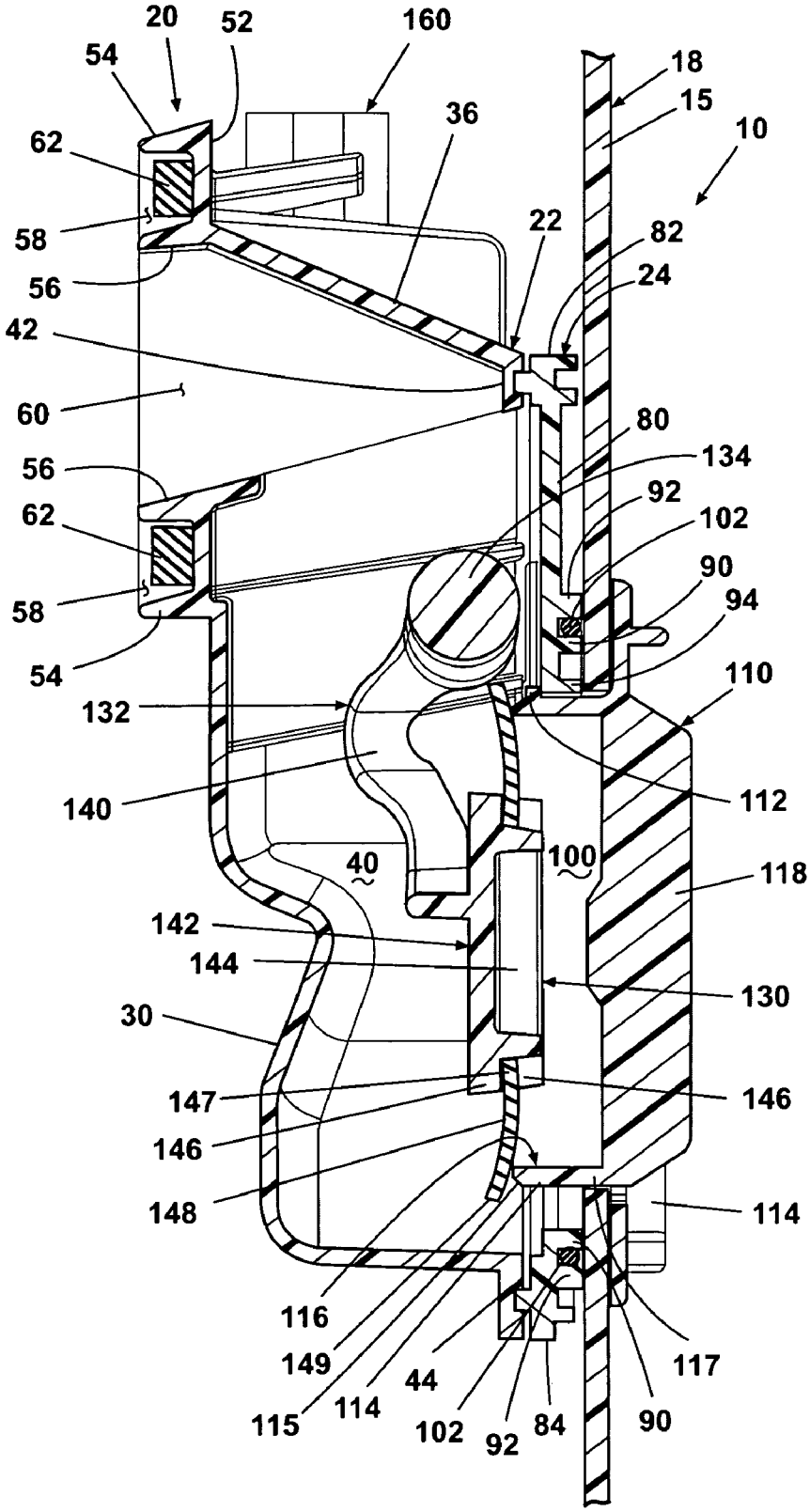
FIG. 9 is a sectional view taken along line 9-9 of FIG. 8, with the inlet cover mounted to the modular exhaust vent.

After the modular exhaust vent 10 is assembled (except for the inlet cover 110), it is mounted to the door 18, and preferably inside the door 18. First, the seal 102 is placed between the inner and outer flanges 90, 92 of the housing cover 24, and the modular exhaust vent 10 is positioned within the door 18 with the housing cover 24 abutting the interior wall 15 of the door 18 and the inlet 100 aligned with the opening 19. Next, the inlet cover 110 is attached to the housing cover 24 by positioning the inlet cover 110 on the opposite side of the opening 19 in the interior wall 15, aligning the detents 122 on the inlet cover 110 with the spaces between the detents 94 on the housing cover 24, and inserting the inlet cover 110 into the inlet 100 until the annular body 112 abuts and overlies the interior wall 15, as shown in FIGS. 7 and 9. In this position, the detents 122 project into the inlet 100 beyond the detents 94, and the rearward portion 114 of the circular wall 116 projects through the inlet 100 so that the inlet 100 is defined by the circular wall 116. Thereafter, the inlet cover 110 is rotated about 60-degrees so that the detents 94 are disposed between the detents 122 and the annular body 112 to thereby retain the inlet cover 110 on the housing cover 24.

When the modular exhaust vent 10 is mounted to the door 18, the wash chamber 16 is in fluid communication with the inlet 100 through the inlet cover 110. The outlet 60 is in communication with an area that is exterior to the door 18 so that air can flow from the modular exhaust vent 10 to the exterior of the dishwasher 12. Because the modular exhaust vent 10 is positioned directly adjacent the interior wall 15, the air flows directly from the wash chamber 16 and into the modular exhaust vent 10 rather than into an upstream space within the door 18 prior to entering the modular exhaust vent 10, as in prior art dishwasher vents. Further, the electrical connection 164 of the actuator 160 is coupled to a power source, preferably through the control system 17.

Figure 6:
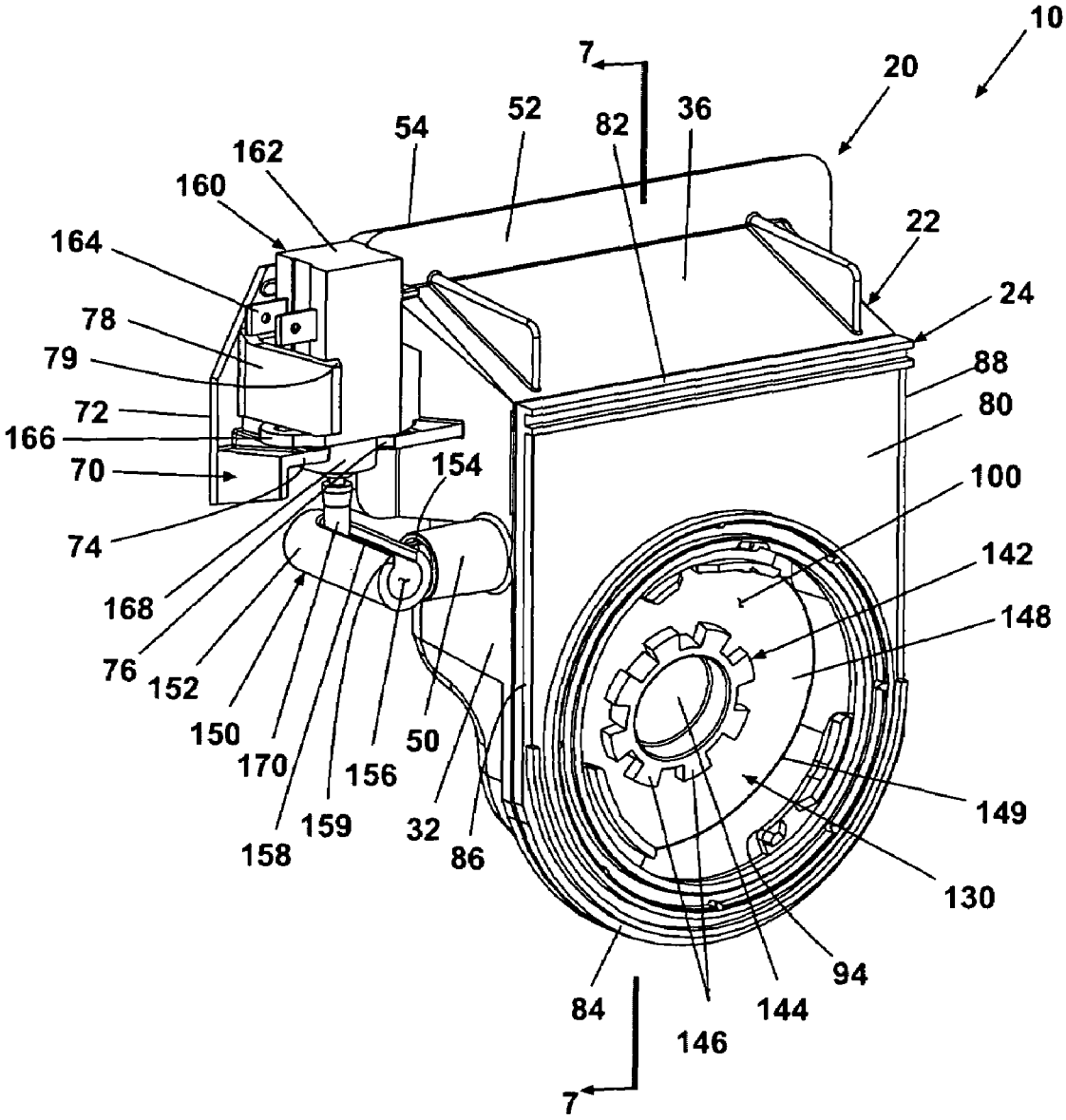
FIG. 6 is a front perspective view of the modular exhaust vent of FIG. 1 with an inlet cover removed and a valve in an opened position.
Figure 8:
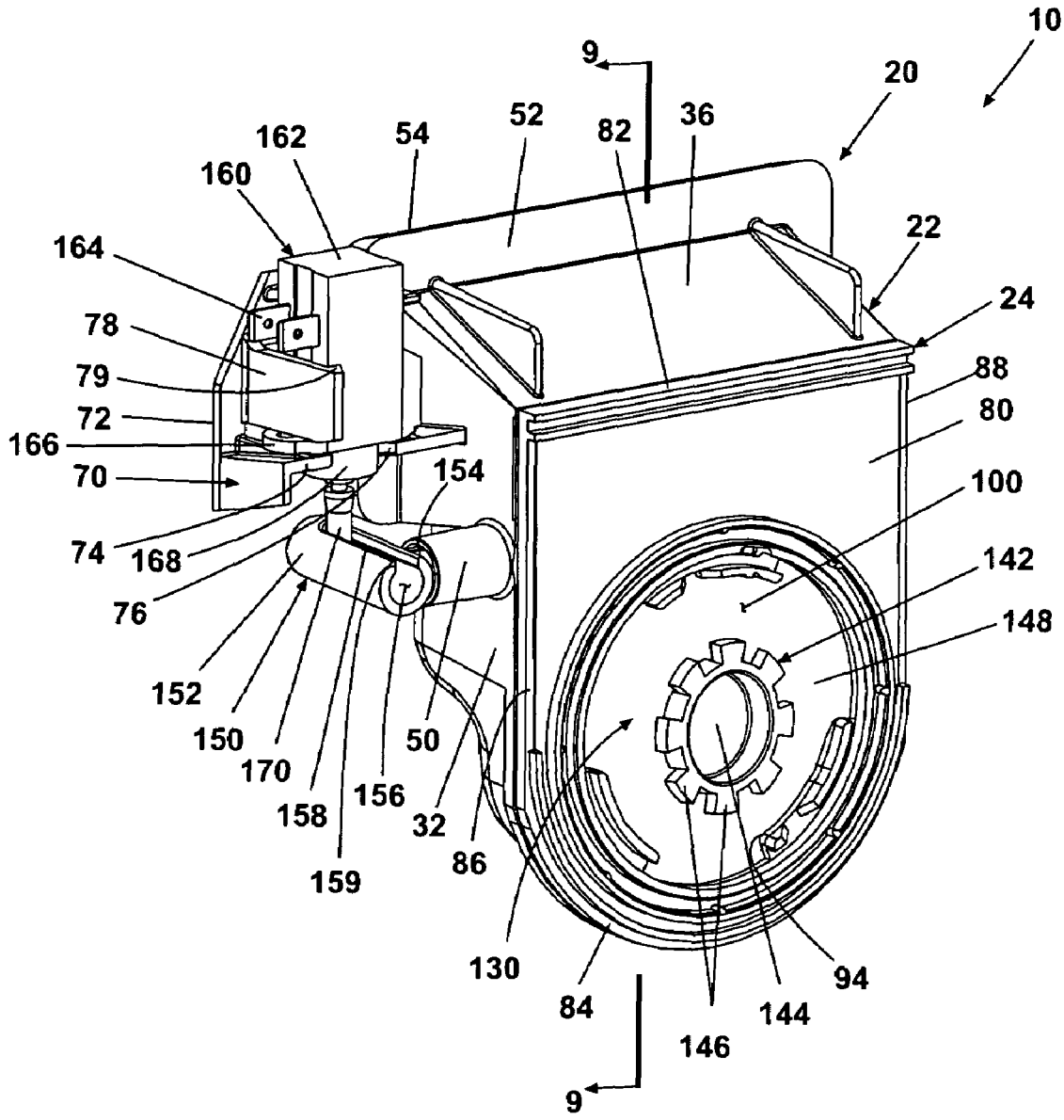
FIG. 8 is a front perspective view similar to FIG. 6 with the valve in a closed position.

The conduit in the housing 20 forms the exhaust flow path 41 for venting air from the wash chamber 16 and through the modular exhaust vent 10 to the exterior of the dishwasher 12. The valve body 148 is disposed near yet spaced from the inlet 100, and the valve 130 and is pivotable about the pivot axis X between an opened position, as shown in FIGS. 6 and 7, wherein the valve body 148 is spaced from the bezel 115 (the valve seat) and the inlet 100 is in fluid communication with the outlet 60, and a closed position, as shown in FIGS. 8 and 9, wherein the valve body 148 abuts the bezel 115 (the valve seat) to close the inlet 100 to prevent air from flowing though the inlet 100 and, thus, through the exhaust flow path 41. When the valve 130 is in the closed position, the valve body 148 seals against the bezel 115 and prevents noise from escaping the dishwasher 12 through the modular exhaust vent 10. The inlet cover 110 is omitted in FIGS. 6 and 8 in order to better illustrate the position of the valve 130 within the housing 20.

An exemplary description of the operation of the modular exhaust vent 10 follows. It will be apparent to one of ordinary skill that the operation can proceed in any logical order and is not limited to the sequence presented below. The following description is for illustrative purposes only and is not intended to limit the invention in any way.

The valve 130 of the modular exhaust vent 10 is normally in the opened position shown in FIGS. 6 and 7. In this position, the shaft 170 of the actuator 160 is in the inactive position, wherein the shaft 170 is retracted within the nipple 168. Consequently, the arm 52 is generally orthogonal to the housing cover 24, and the hinge 134 is oriented such that the valve body 148 is spaced from the bezel 115 (the valve seat) and the inlet 100. As a result, the inlet 100 of the exhaust flow path 41 is in fluid communication with the outlet 60, and, therefore, the wash chamber 16 is in fluid communication with the exterior of the dishwasher 12.

After a user loads the dishwasher 12 with dishes, moves the door 18 to the closed position, and instructs the control system 17 to begin an operational cycle, such as by depressing a button or other switch on the door 18, the control system 17 of the dishwasher 12 begins a wash cycle and sends a signal, preferably in the form of an electric current, to the actuator 160 of the modular exhaust vent 10 to move the valve 130 to the closed position to thereby prevent transmission of noise generated during the wash cycle through the opening 19 and the modular exhaust vent 10 to the exterior of the dishwasher 12. Upon receipt of the signal, the shaft 170 moves to the active position. As the shaft 170 extends away from the motor body 162 and towards the link 150, the terminal ball 172 pushes the arm 152 and thereby forces the arm 152 pivot about the pivot axis X and the extension 154 to rotate along the pivot axis X. The slot 158 accommodates movement of the shaft 170 along the longitudinal axis Y as the arm 152 rotates. Because the extension 154 is keyed into the hinge 132 through the key 137, the rotation of the extension 154 induces rotation of the hinge 132. As the hinge 132 rotates, the valve body support 142 and the valve body 148 pivot about the pivot axis X and towards the inlet 100 until the valve 130 reaches the closed position, wherein the valve body 148 abuts the bezel 115 (the valve seat) to close the exhaust flow path 41 at the inlet 100. In this position, the valve body 148 prevents transmission of noise along the exhaust flow path 41. Additionally, because the modular exhaust vent 10 is positioned directly adjacent the interior wall 15 and the opening 19 in the door 18 and the valve body 148 selectively closes the inlet 100, the upstream space between the wash chamber 16 and the inlet 100 commonly present in prior art dishwashers 12 is eliminated, which reduces the transmission of noise to the exterior of the dishwasher 12 even when the valve 130 is in the closed position. In prior dishwashers, the upstream space created a resonance chamber that permitted the sound at certain frequencies in the chamber to effectively bypass the valve 130.

Figure 10:
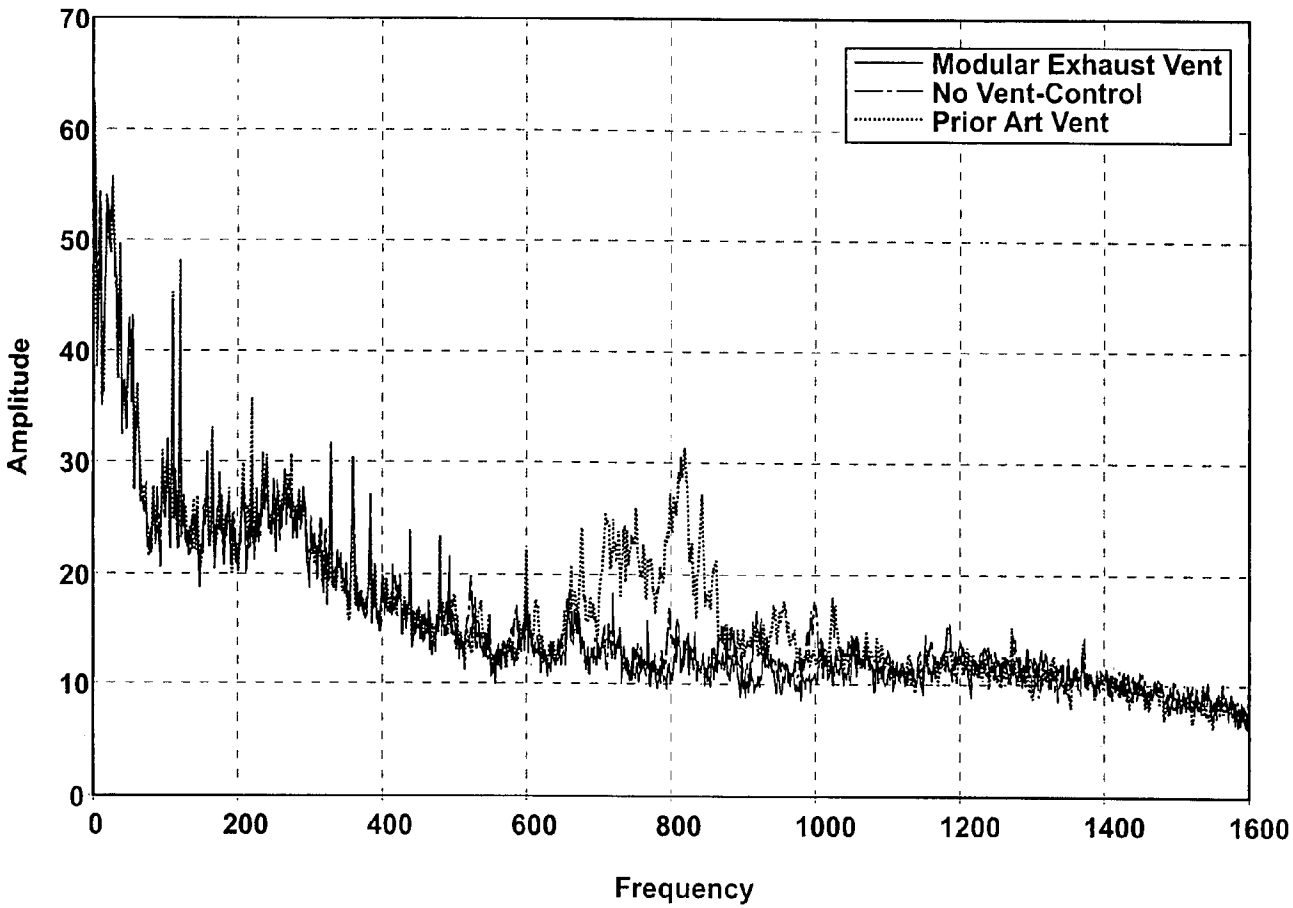
FIG. 10 is a graph illustrating noise reduction achieved by the modular exhaust vent of FIG. 1 compared to a prior art exhaust vent.

The sound reduction achieved by the modular exhaust vent 10 is graphically illustrated in FIG. 10. The solid line in the graph depicts the amplitude of sound transmitted through the dishwasher 12 equipped with the modular exhaust vent 10 over a range of frequencies, while the dashed line indicates the amplitude of sound transmitted through a dishwasher equipped with a prior art modular exhaust vent. The particular prior art exhaust vent employed in the test is the vent disclosed in U.S. Pat. No. 6,293,289 to Hapke et al. (Hapke '289), which is incorporated herein by reference. The Hapke '289 vent comprises a valve that selective closes an opening in a wall positioned between the vent inlet and the vent outlet. As a result, an upstream space is created between the valve and the vent inlet. Conversely, the valve body 148 of the modular exhaust vent 10 is positioned to directly close the inlet 100 and thereby prevent formation of an upstream space. The dot-dash-dot line represents a control dishwasher wherein the opening in the interior wall of the door is blocked without a vent.

The amplitude is a measurement of the magnitude of the sound, and a larger amplitude corresponds to louder noise. As seen in the graph, the sound transmitted by the prior art dishwasher has a significant increase in amplitude at frequencies around 800 Hz, which is within a range of audible frequencies. At these frequencies, the sound resonates within the space in the door and upstream of the prior art vent. The frequency that resonates in the upstream space depends on the volume of the space and, thus, the position of the modular exhaust vent within the door. However, the amplitude of the sound transmitted by the dishwasher 12 equipped with the modular exhaust vent 10, which creates a seal generally coincident with the interior wall 15 of the door 18, is significantly reduced at these frequencies. Additionally, a comparison of the amplitude of the sound transmitted by the dishwasher 12 equipped with the modular exhaust vent 10 with the sound transmitted by the control dishwasher reveals that the modular exhaust vent 10 and its position relative to the door 18 effectively eliminates the resonation problems associated with the prior art modular exhaust vent.

When the wash cycle is complete, the control system 17 begins a dry cycle and terminates the signal previously sent to the actuator 160 during the wash cycle to return the valve 130 to the opened position. Upon termination of the signal, the shaft 170 retracts into the motor body 162 to the inactive position and, because the diameter of the terminal ball 172 is larger than the width of the slot 158, thereby pulls the link 150 towards the actuator support 70 to the position generally orthogonal to the housing cover 24. As the shaft 170 pulls the link 150, the arm 152 pivots about the pivot axis X, and the hinge rotates along to the pivot axis X to pivot the valve body support 142 and the valve body 148 about the pivot axis X and away from the inlet 100 until the valve 130 reaches the opened position, wherein the valve body 148 is spaced from the bezel 115 (the valve seat). Moisture-laden air within the wash chamber 16 exits the wash chamber 16 and enters the modular exhaust vent 10 through the apertures 120 in the inlet cover 110. At this point, the air enters the inlet 100 and travels through the exhaust flow path 41 in the chamber 40 and past the valve body 148 before exiting the modular exhaust vent 10 through the outlet 60. Upon leaving the modular exhaust vent 10, the air flows to the exterior of the dishwasher 12.

The valve 130 of the modular exhaust vent 10 described above is normally in the opened position and moves to the closed position upon receipt of a signal. However, it is within the scope of the invention for the valve 130 to operate in an opposite manner, wherein the valve 130 is normally in the closed position and moves to the opened position upon receipt of a signal. In the latter case, the actuator 160 can be a pull-type wax motor comprising a shaft 170 that is extended in the inactive position and retracts in the active condition to pull the arm 152 of the link 150 and open the valve 130.

Further, the link 150 for connecting the actuator 160 to the valve 130 can comprise an arm 152 that is keyed to mate with the hinge 134 directly, rather than being coupled thereto by an extension 154. Alternatively, the arm 152 can be coupled to the hinge 134 by a mechanism or member other than the extension 154 described above.

An alternative embodiment of a modular exhaust vent 10' according to the invention is illustrated in FIGS. 11-18A, where components similar to those of the first embodiment modular exhaust vent 10 are identified with the same reference numeral bearing a prime (') symbol. The modular exhaust vent 10' comprises a housing 20' that defines a conduit, a valve 130' mounted within the conduit in the housing 20', and an actuator 160' supported on the housing 20' and in direct communication with the valve 130' for operating the valve 130'. Movement of the valve 130' by the actuator 160' opens and closes an exhaust flow path 41 formed by the conduit for selectively venting air from the wash chamber 16.

Referring particularly to FIGS. 11-14, the housing 20' is preferably a unitary body with an upper portion 20A' and a lower portion 20B'. The upper portion 20A' comprises opposing, inclined rear and front walls 30A', 24A' joined by opposing first and second side walls 32A', 34A'. The upper portion 20A' further includes a generally rectangular rear flange 52' around the upper ends of the rear and front walls 30A', 24A' and the first and second side walls 32A', 34A'. The rear flange 52' includes rearwardly extending and generally rectangular outer rim 54'. The rear flange 52' and the outer rim 54' form a rectangular channel 58' that is sized to receive a seal 62' and defines an outlet 60' for the conduit.

The lower portion 20B' comprises opposing rear and front walls 30B', 24B' joined by an arcuate side wall 33B'. Two circular flanges, an inner flange 90' and an outer flange 92', on the front wall 24B' form a recess 91' therebetween sized to receive a seal 102', and the inner flange 90' defines an inlet 100' for the conduit. The front wall 24B' also includes circumferentially spaced detents 94' that project radially inward from the inner flange 90' for removably mounting an inlet cover 110' thereto. Further, the lower portion 20B' includes a pair of laterally aligned indentations 46' in a lower portion of the side wall 33B' and an inwardly protruding projection 50' that extends forward from the rear wall 30B' and radially inward from the lower portion of the side wall 33B'. The projection 50' is hollow and comprises an opening 51' sized to receive a portion of the actuator 70', as will be described in further detail hereinafter. The upper and lower portions 20A' and 20B' together form an inner chamber 40', and the conduit defined by the housing 20' extends from the inlet 100' to the outlet 60'.

An actuator support 70' formed integrally with lower portions of the rear wall 30B' and the side wall 33B' comprises spaced rear and front walls 72', 71' joined by substantially vertical first and second side walls 73', 75' and a bottom wall 74'. A horizontally oriented, cylindrical actuator recess 77' within the actuator support 70' joins with the hollow interior of the projection 50' and opens through the first side wall 73'. Further, the actuator support 70' comprises a pair of braces 78', an upper brace 78A' and a lower brace 78B', spaced from the first side wall 33' by integral ligaments 66'. The ligament 66' on the lower brace 78B' includes a stop 68' at a rearward portion of the lower brace 78B'.

Figure 3:
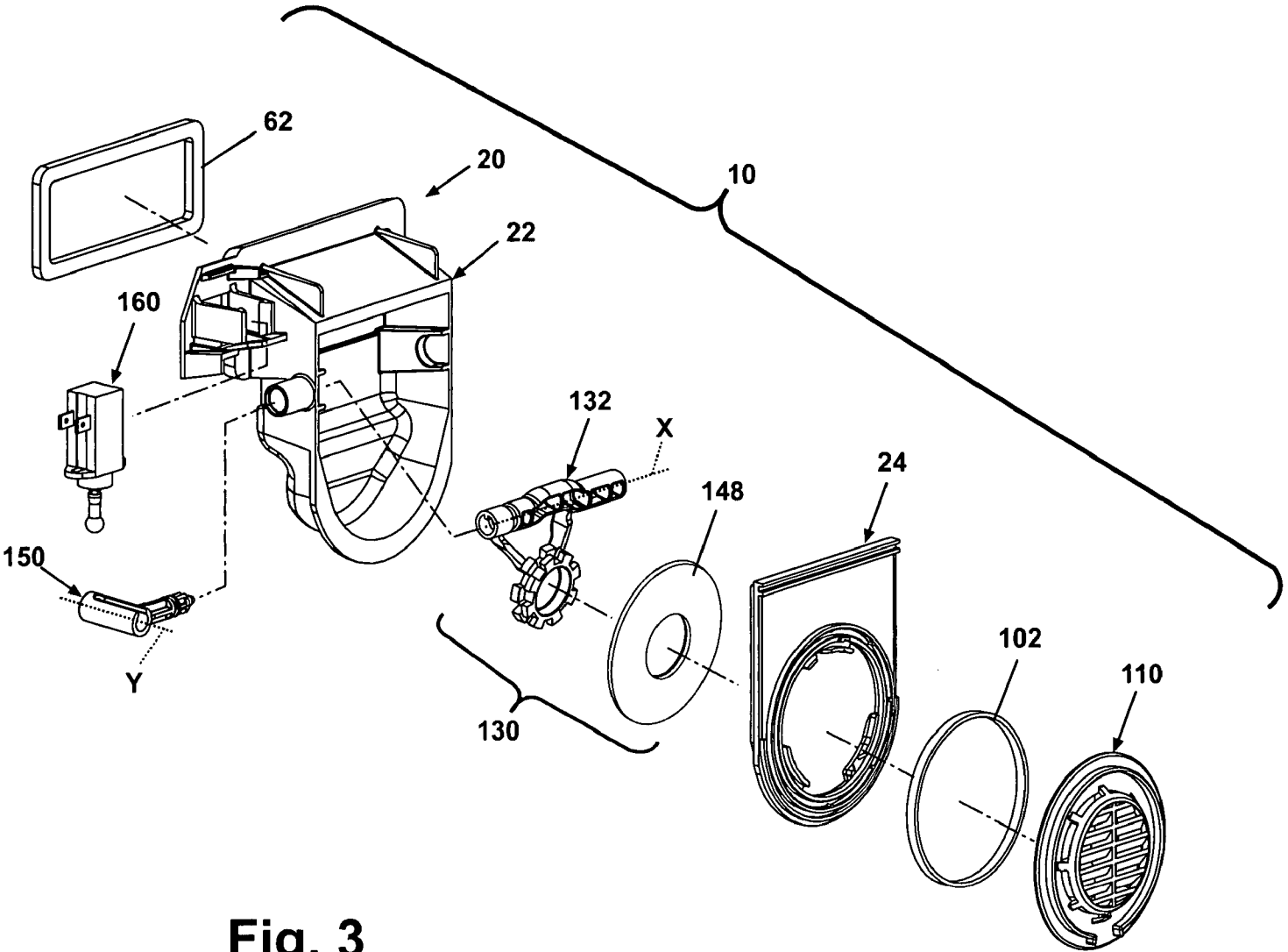
FIG. 3 is an exploded view of FIG. 2.
Figure 3A:
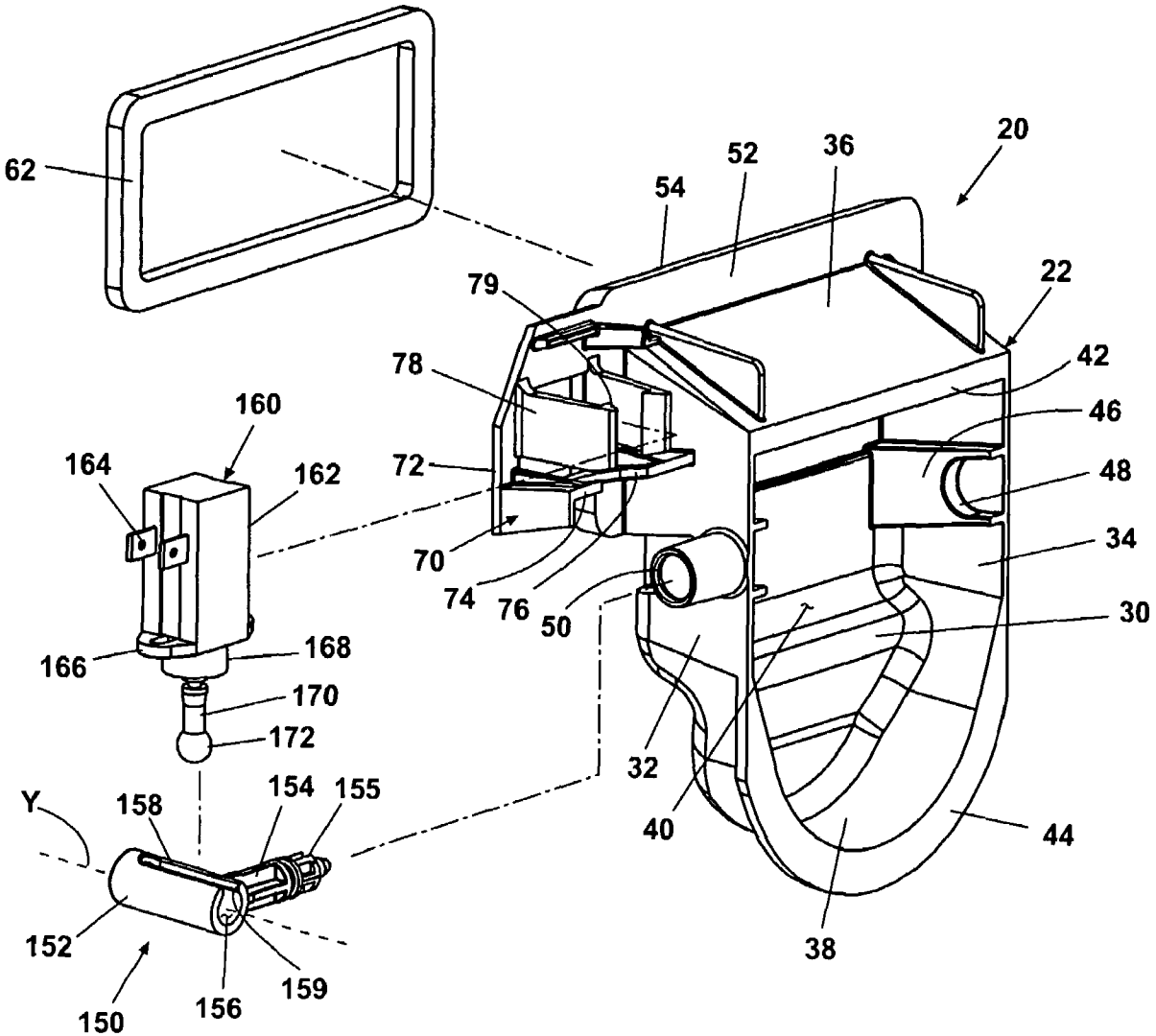
FIGS. 3A and 3B are enlarged views of portions of FIG. 3.
Figure 3B:
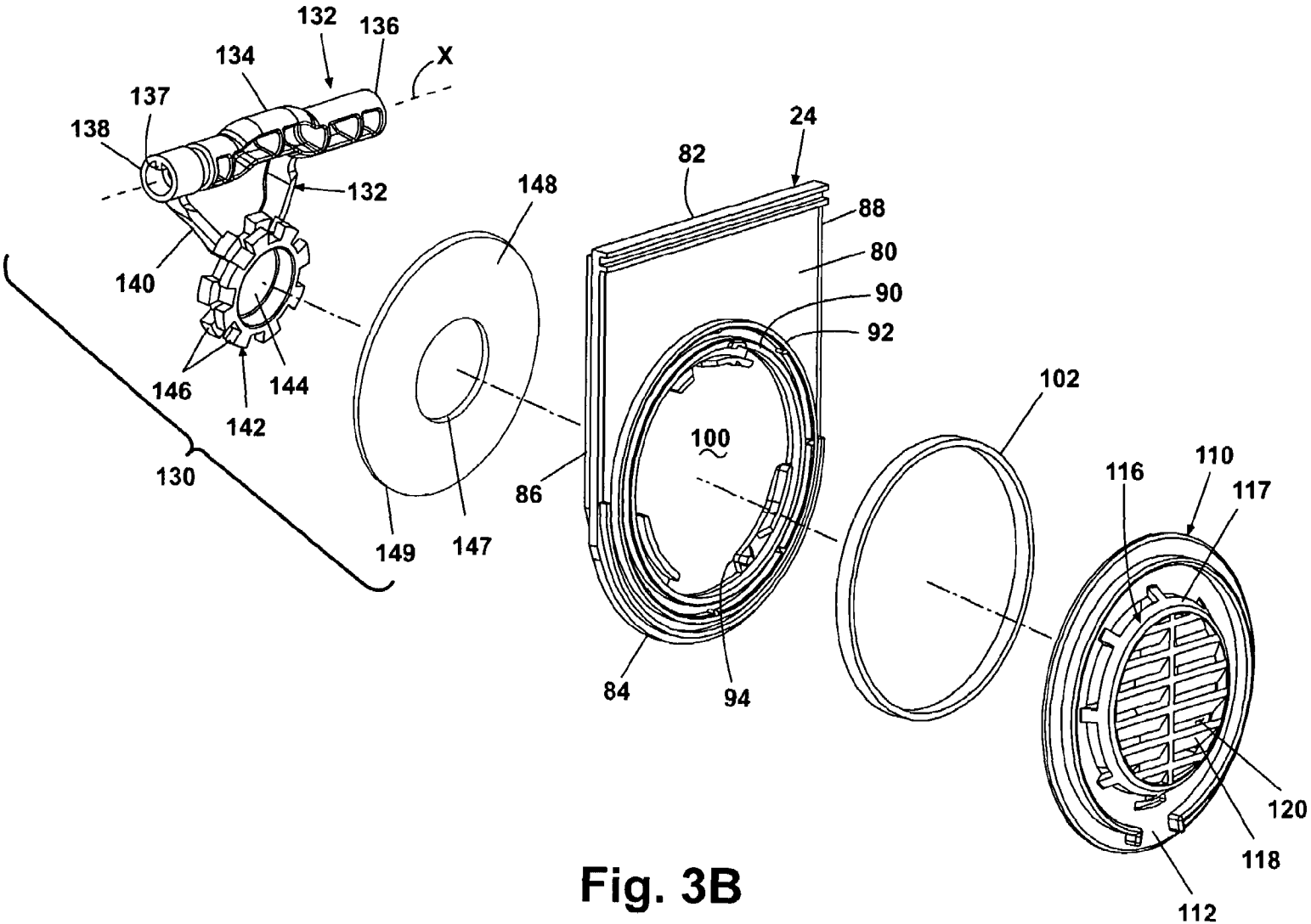
Figure 4:
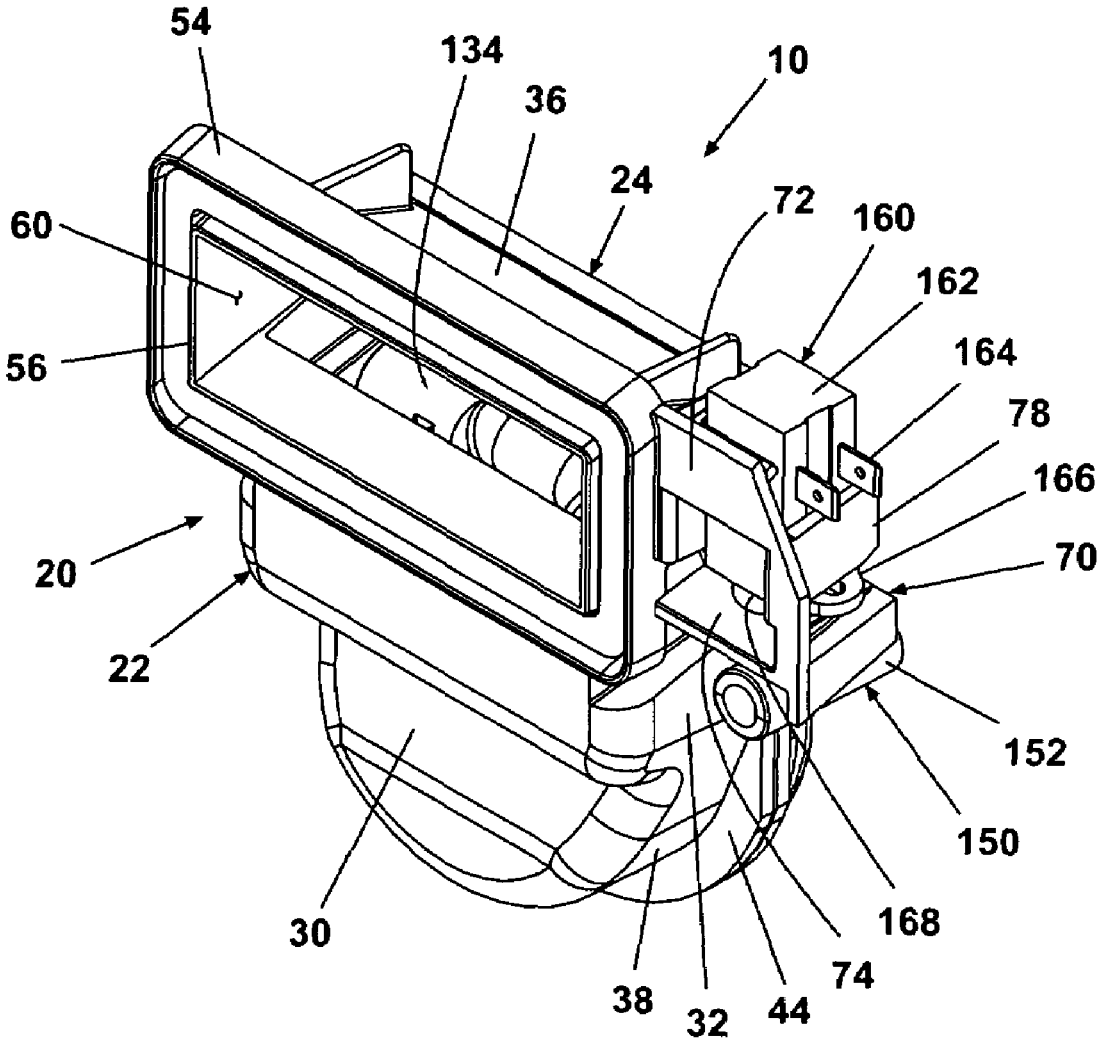
FIG. 4 is a rear perspective view of the modular exhaust vent of FIG. 1.
Figure 5:
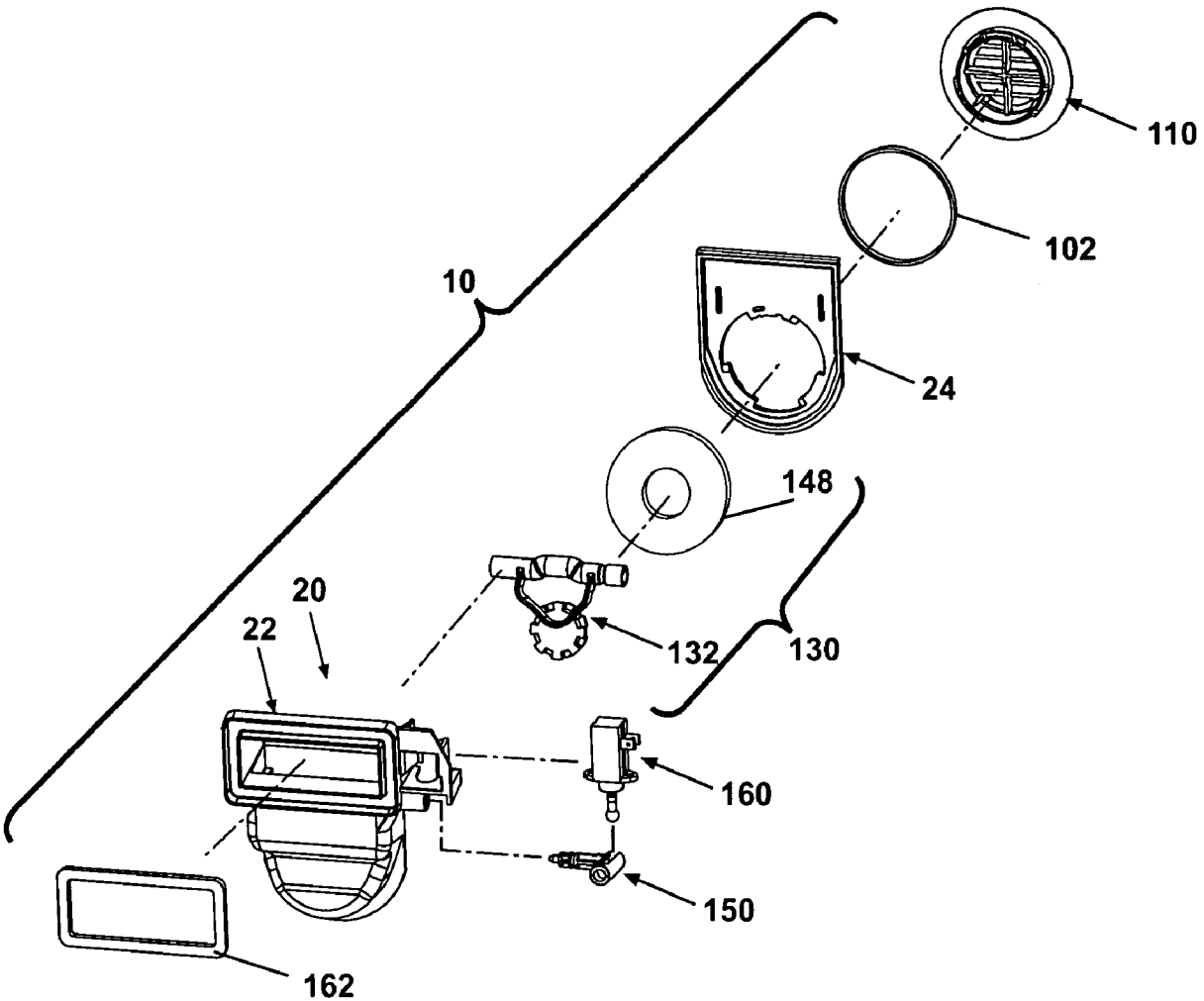
FIG. 5 is an exploded view of FIG. 4.
Figure 5A:
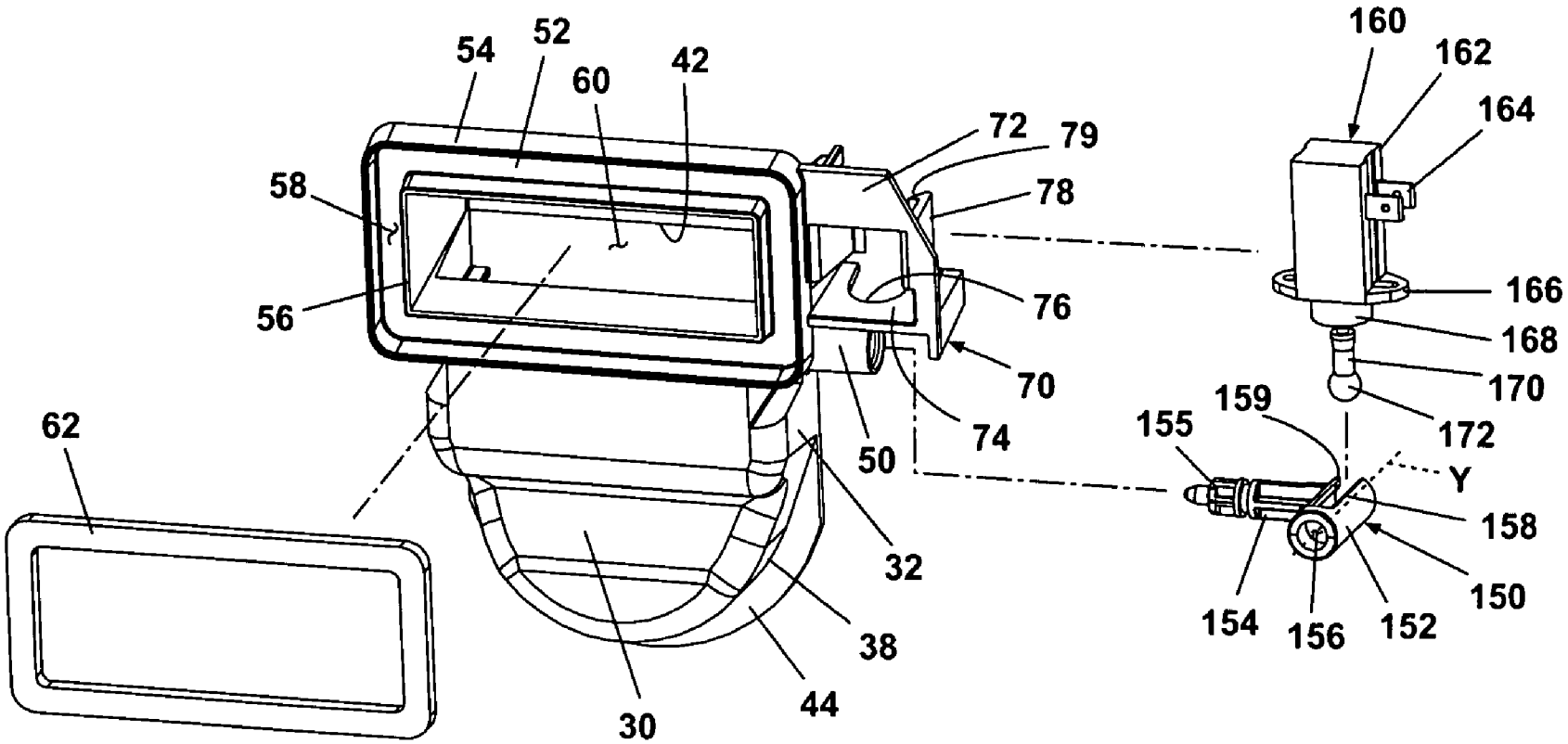
FIGS. 5A and 5B are enlarged views of portions of FIG. 5.
Figure 5B:
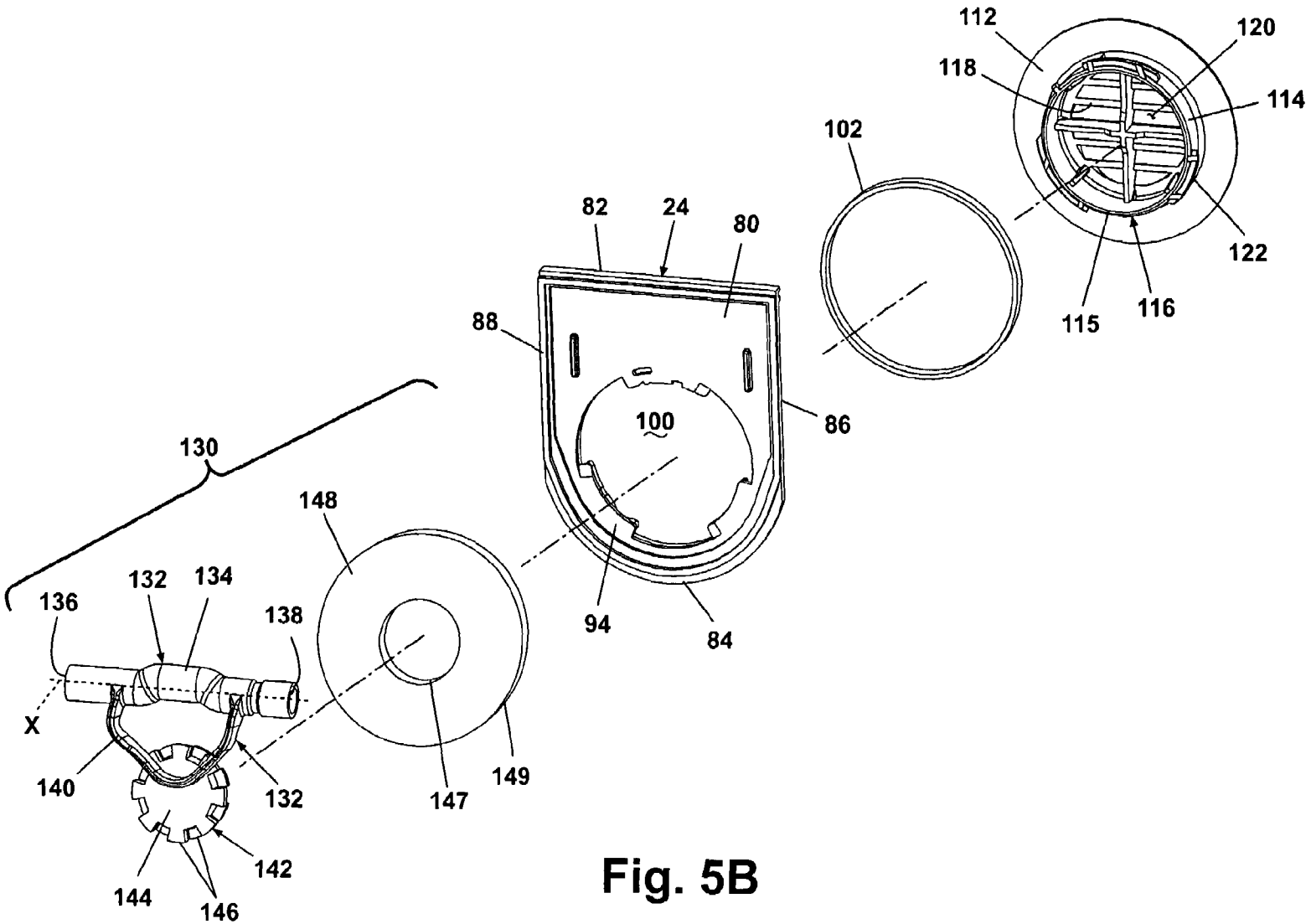
Figure 11:
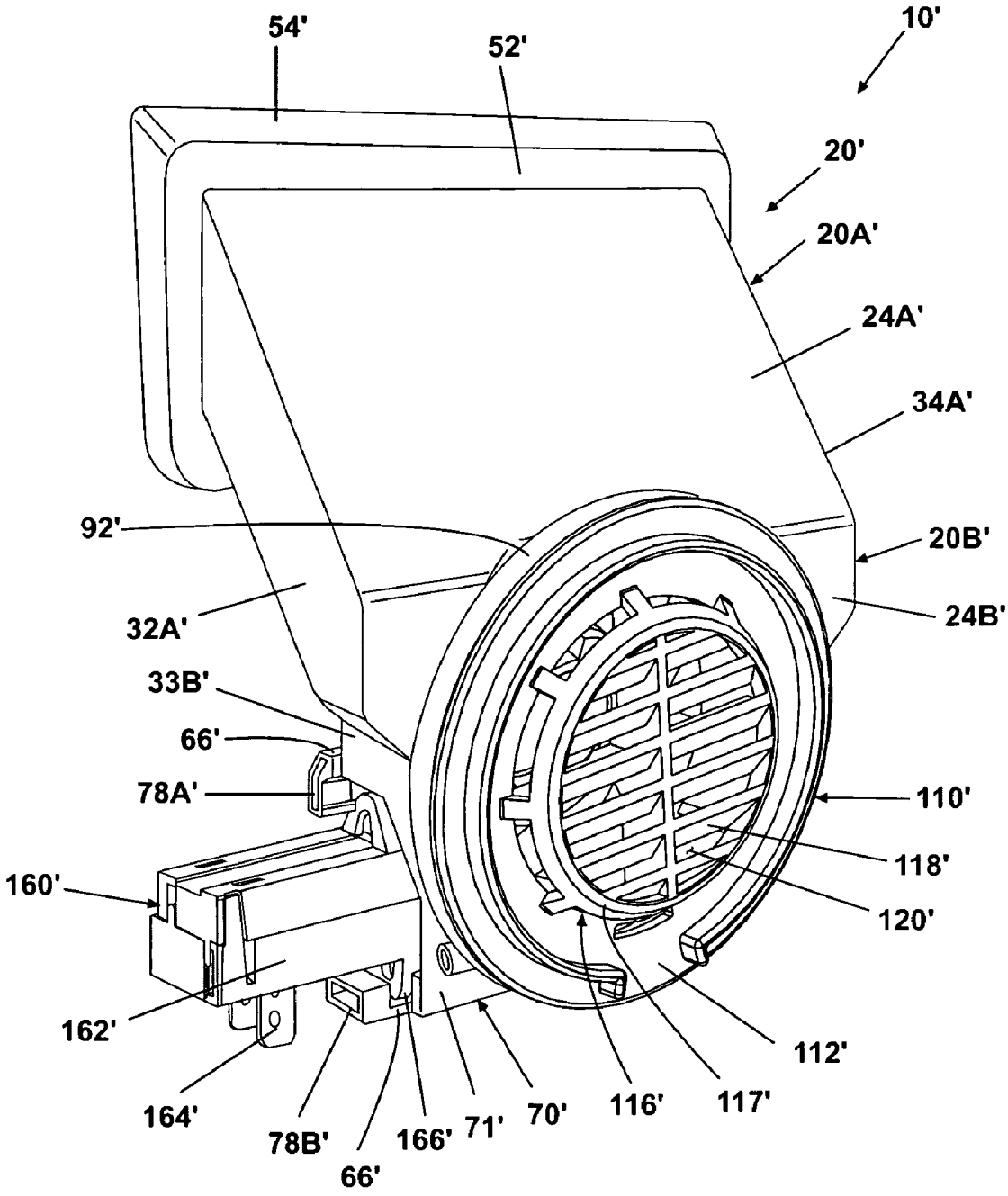
FIG. 11 is a front perspective view of an alternative embodiment of a modular exhaust vent according to the invention.
Figure 12:
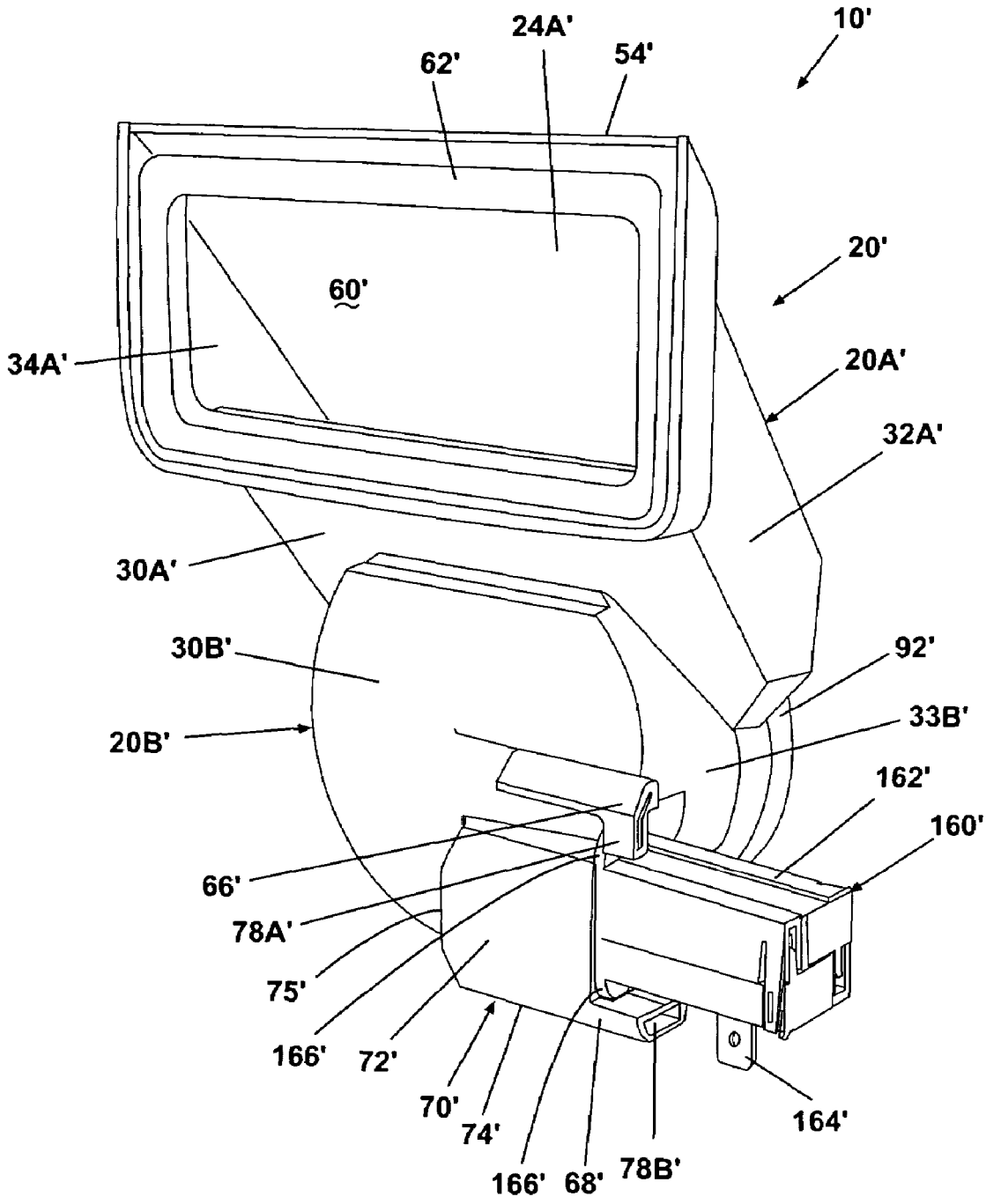
FIG. 12 is a rear perspective view of the modular exhaust vent of FIG. 11.
Figure 13:
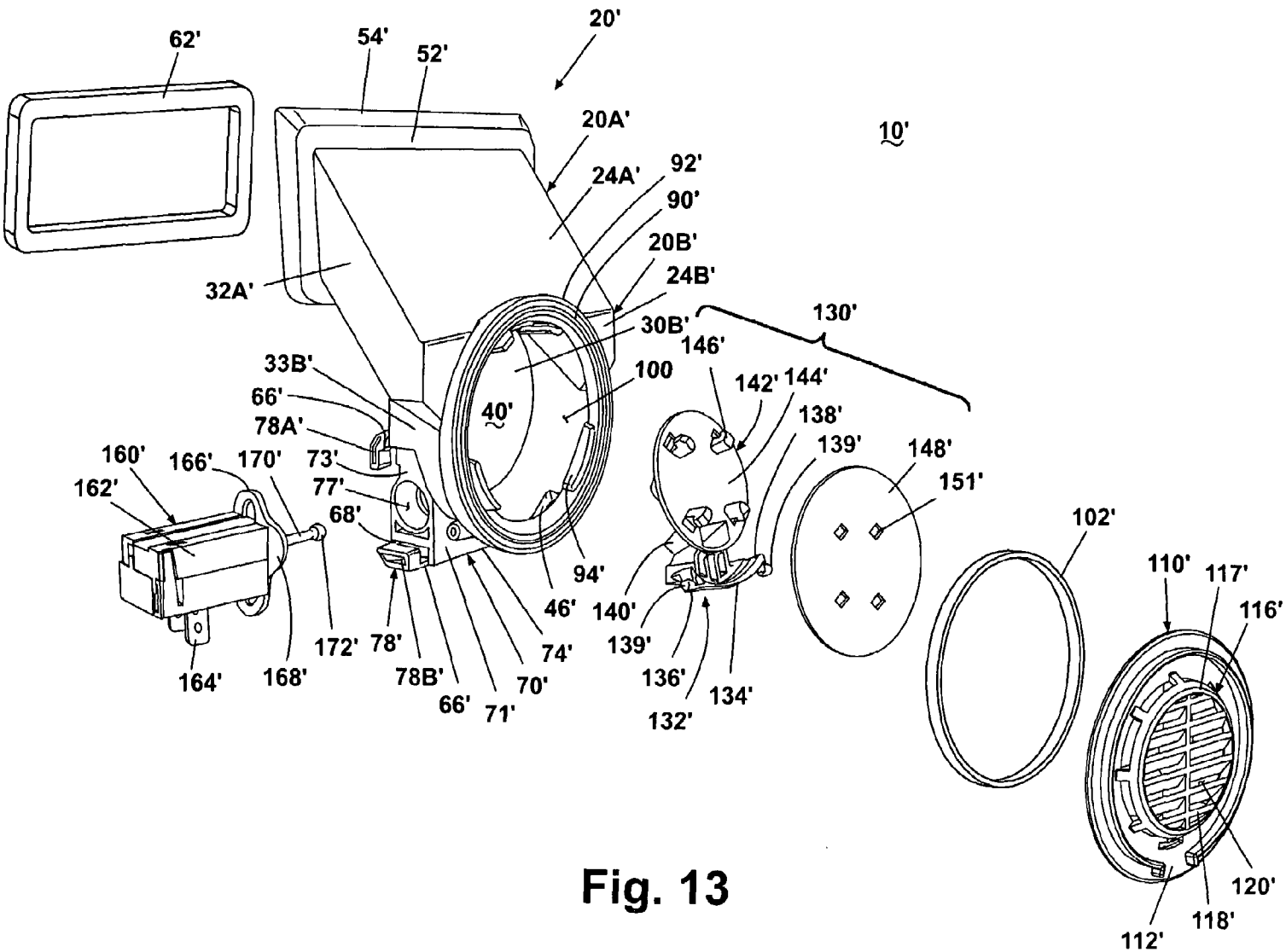
FIG. 13 is an exploded view of the modular exhaust vent of FIG. 11.
Figure 14:
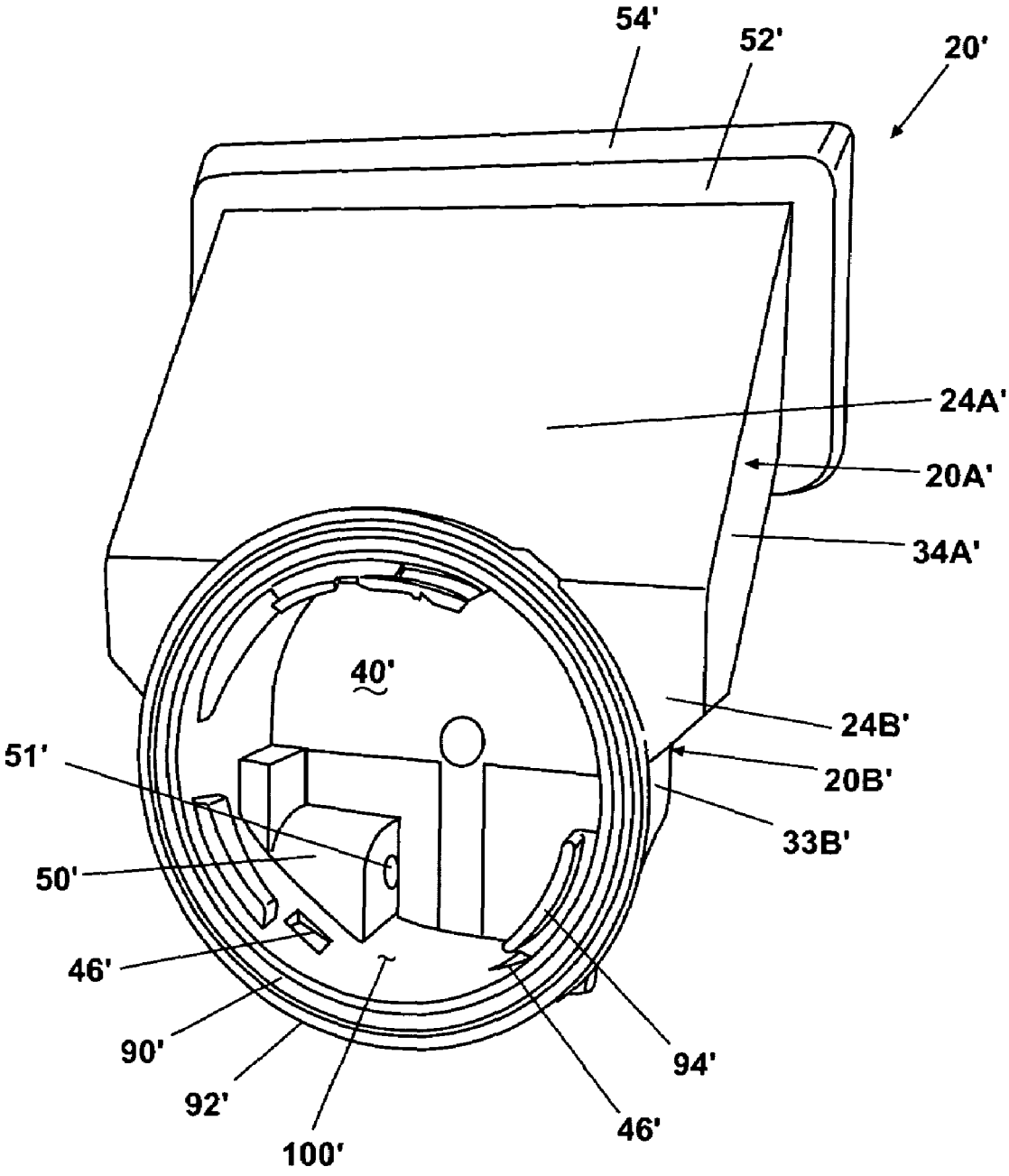
FIG. 14 is front perspective view of a housing from the modular exhaust vent of FIG. 11.

The inlet cover 110', which is best viewed in FIGS. 11 and 13, is identical to the inlet cover 110 of the first embodiment modular exhaust vent 10 (see FIGS. 3B and 5B). The inlet cover 110' is a generally circular member with an annular body 112' and a circular wall 116' generally perpendicular to the annular body 112' and having a forward portion 117' on one side of the annular body 112' and a rearward portion 114' on an opposite side of the annular body 112'. The forward portion 117' surrounds a plurality of louvers 118', which define a plurality of apertures 120', while the rearward portion 114' terminates at a bezel 115' and includes circumferentially spaced detents 122' extending radially outward from the circular wall 116' and sized for receipt between the detents 94' of the front wall 24B'. The bezel 115 on the rearward portion 114' of the circular wall 116' functions as a valve seat for the valve 130'.

Figure 15:
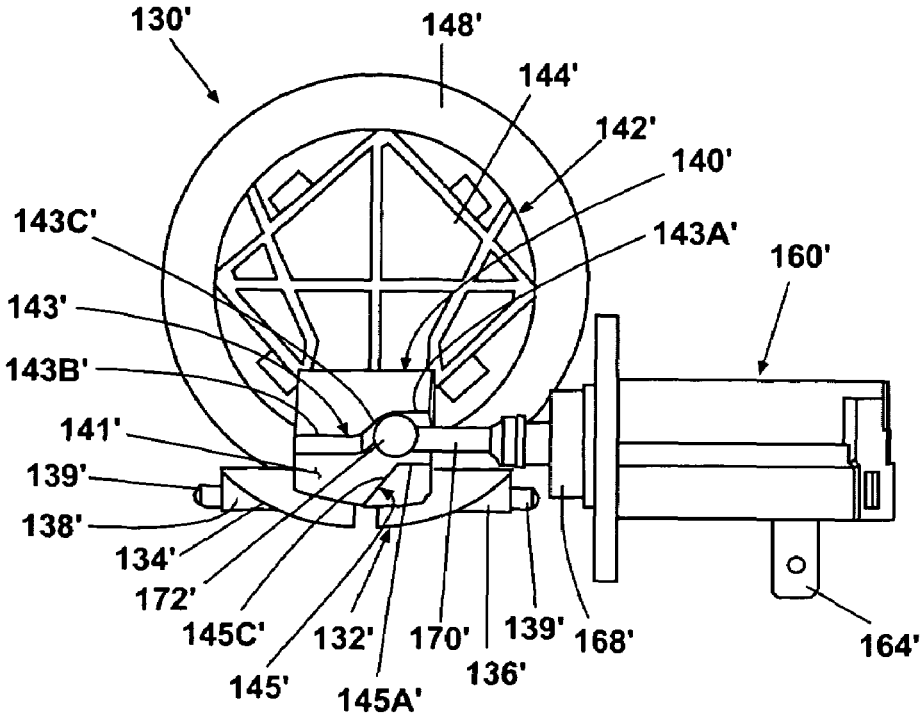
FIG. 15 is rear view of a valve and an actuator from the modular exhaust vent of FIG. 11, wherein the actuator is in an inactive position.

Referring particularly to FIGS. 13 and 15, the valve 130', which is mounted inside the housing 20', comprises a frame 132' that carries or supports a resilient, flexible annular valve disk or body 148' having a plurality of apertures 151'. The frame 132' has a hinge 134' with a first end 136' and a second end 138' sized for receipt within the indentations 46' on the side wall 33B' on the lower portion 20B' of the housing 20'. Each of the first and second ends 136', 138' terminates at a nub 139' for pivotally mounting the frame 132' in the indentations 46' of the housing 20'. The hinge 134' defines a pivot axis X' and is joined to a valve body support 142' by a connector 140'. The valve body support 142' comprises a circular body 144' and a plurality of protruding hooked fingers 146 sized to be received within the apertures 151' on the valve body 148' for retaining the valve body 148' on the valve body support 142'. The connector 140' includes a groove 141' defined between a first cam surface 143' and a second cam surface 145' spaced from the first cam surface 143'. The first cam surface 143' comprises a first horizontal section 143A' and a laterally offset second horizontal section 143B' joined by a diagonal section 143C', while the second cam surface 145' comprises a horizontal section 145A' spaced from and parallel with the first horizontal section 143A' and a diagonal section 145C' spaced from and parallel with the diagonal section 143C'.

Similar to the actuator 160 of the first embodiment modular exhaust vent 10, the actuator 160' for operating the valve 130' is preferably a conventional push-style wax motor comprising a generally rectangular motor body 162' with an electrical connection 164' for coupling the actuator 160' to a source of power. At one end of the motor body 162', side flanges 166' project from opposite sides thereof to facilitate mounting the actuator 160' to the actuator support 70'. The actuator 160' further includes a nipple 168' that surrounds a movable shaft 170' having a terminal ball 172' sized for receipt within the groove 141' of the connector 140'. The shaft 170' is movable between an inactive position, wherein the shaft 170' is retracted towards the motor body 162', and an active position, wherein the shaft 170' is displaced in a direction away from the motor body 162'.

An exemplary description of the assembly of the modular exhaust vent 10' follows. It will be apparent to one of ordinary skill that the operation can proceed in any logical order and is not limited to the sequence presented below. The following description is for illustrative purposes only and is not intended to limit the invention in any way.

To assemble the modular exhaust vent 10', the valve body 148' is attached the frame 132' by aligning the apertures 151' with the hooked fingers 146' and pushing the valve body 148' onto the circular body 144' of the valve body support 142'. Next, the valve 130' is mounted to the housing 20' by sliding the first and second ends 136', 138' of the hinge 134' into the indentations 46' in the side wall 33B' so that the nubs 139' abut the housing 20'. Because the hinge 134' can rotate within the indentations 46', and the valve 130' can pivot about the pivot axis X' within the chamber 40'.

Figure 15A:
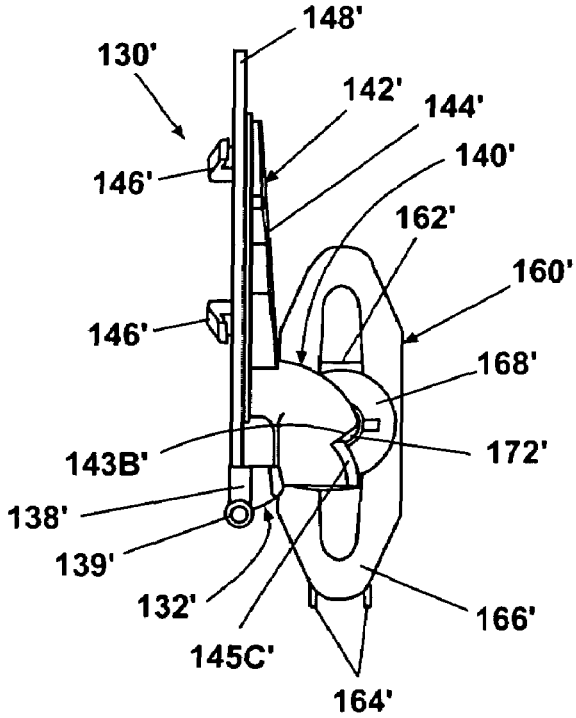
FIG. 15A is a side view of the valve and actuator of FIG. 15.

After the valve 130' is properly positioned, the actuator 160' is mounted to the actuator support 70' and operably coupled to the valve 130'. To accomplish this, the nipple 168' is inserted into the actuator recess 77' with the side flanges 166' oriented laterally (i.e., parallel with the bottom wall 74'). In this position, the terminal ball 172' extends into the chamber 40' through the opening 51' in the projection 50'. In particular, the terminal ball 172' resides in the groove 141' of the connector 140' between the first horizontal section 143A' and the horizontal section 145A', as shown in FIGS. 15 and 15A. Next, the actuator 160' is rotated about 90-degrees so that the side flanges 166' pass through the spaces between the braces 78' and the first side wall 73' until further rotation is prevented by the stop 68' on the ligament 66' of the lower brace 78B'. When rotation ceases, the side flanges 166' are positioned such that they generally vertical and are held between the braces 78' and the first side wall 73' to retain the actuator 160' on the actuator support 70'. Finally, the seal 62' is inserted into the channel 58' around the outlet 60' of the housing 20'.

After the modular exhaust vent 10' is assembled (except for the inlet cover 110', it is mounted to the door 18, and preferably inside the door 18. First, the seal 102' is placed between the inner and outer flanges 90', 92' of the front wall 24A', and the modular exhaust vent 10' is positioned within the door 18 with the front wall 24A' abutting the interior wall 15 of the door 18 and the inlet 100' aligned with the opening 19. Next, the inlet cover 110' is attached to the housing 20' by positioning the inlet cover 110' on the opposite side of the opening 19 in the interior wall 15, aligning the detents 122' on the inlet cover 110' with the spaces between the detents 94' on the front wall 24A', and inserting the inlet cover 110' into the inlet 100' until the annular body 112' abuts and overlies the interior wall 15. In this position, the detents 122' project into the inlet 100' beyond the detents 94', and the rearward portion 114' of the circular wall 116' projects through the inlet 100' so that the inlet 100' is defined by the circular wall 116'. Thereafter, the inlet cover 110' is rotated about 60-degrees so that the detents 94' are disposed between the detents 122' and the annular body 112' to thereby retain the inlet cover 110' on the housing 20'.

When the modular exhaust vent 10' is mounted to the door 18, the wash chamber 16 is in fluid communication with the inlet 100' through the inlet cover 110'. The outlet 60' is in communication with an area that is exterior to the door 18 so that air can flow from the modular exhaust vent 10' to the exterior of the dishwasher 12. Because the modular exhaust vent 10' is positioned directly adjacent the interior wall 15, the air flows directly from the wash chamber 16 and into the modular exhaust vent 10' rather than into an upstream space within the door 18 prior to entering the modular exhaust vent 10, as in prior art dishwasher vents. Further, the electrical connection 164' of the actuator 160' is coupled to a power source, preferably through the control system 17.

Figure 16:
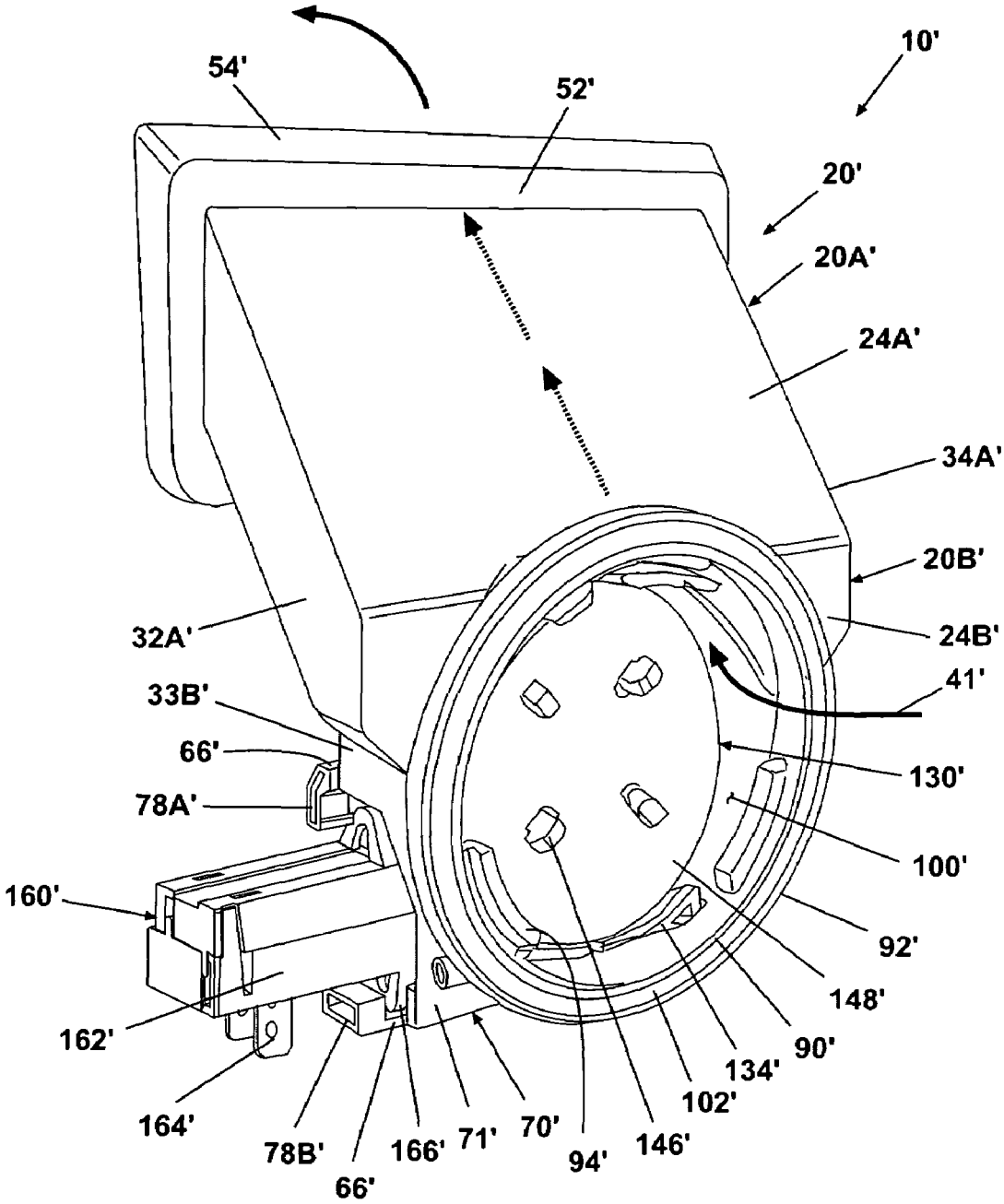
FIG. 16 is a front perspective view of the modular exhaust vent of FIG. 11 with an inlet cover removed and the valve in an opened position.
Figure 17:
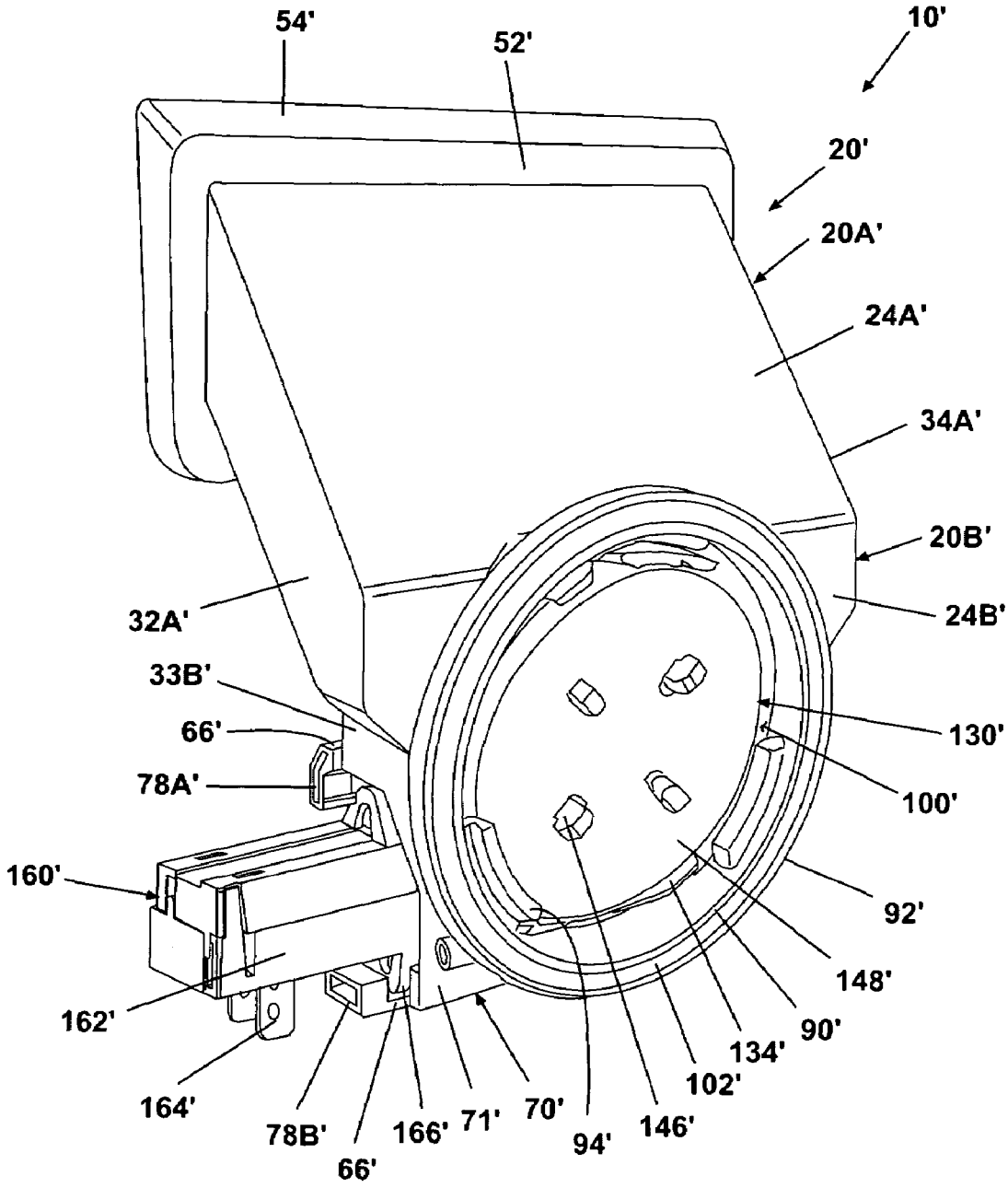
FIG. 17 is a front perspective view similar to FIG. 16 with the valve in a closed position.

The conduit in the housing 20' forms the exhaust flow path 41' (FIG. 16) for venting air from the wash chamber 16 and through the modular exhaust vent 10' to the exterior of the dishwasher 12. The valve body 148' is disposed near yet spaced from the inlet 100', and the valve 130' is pivotable about the pivot axis X' between an opened position, as shown in FIG. 16, wherein the valve body 148' is spaced from the bezel 115' (the valve seat) of the inlet cover 110', and the inlet 100' is in fluid communication with the outlet 60', and a closed position, as shown in FIG. 17, wherein the valve body 148' abuts the bezel 115' (the valve seat) of the inlet cover 110' to close the inlet 100' to prevent air from flowing through the inlet 100' and, thus, through the exhaust flow path 41'. When the valve 130' is in the closed position, the valve body 148' seals against the bezel 115 and prevents noise from escaping the dishwasher 12 through the modular exhaust vent 10'. The inlet cover 110' is omitted in FIGS. 16 and 17 in order to better illustrate the position of the valve 130' within the housing 20'.

The operation of the modular exhaust vent 10' is substantially the same as that of the first embodiment modular exhaust vent 10, except for the interaction between the actuator 160' and the valve 130' to move the valve 130' between the opened and closed positions. As in the first embodiment, the valve 130' of the modular exhaust vent 10' is normally in the opened position shown in FIGS. 16 and 17. In this position, the shaft 170' of the actuator 160' is in the inactive position, shown in FIGS. 15 and 15A, wherein the shaft 170' is retracted within the nipple 168'. Consequently, the terminal ball 172' resides in the groove 141' of the connector 140' between the first horizontal section 143A' and the horizontal section 145A', and the hinge 134' is oriented such that the valve body 148' is spaced from the rearward wall 116' and the inlet 100'. As a result, the inlet 100' of the exhaust flow path 41' is in fluid communication with the outlet 60', and, therefore, the wash chamber 16 is in fluid communication with the exterior of the dishwasher 12.

Figure 18:
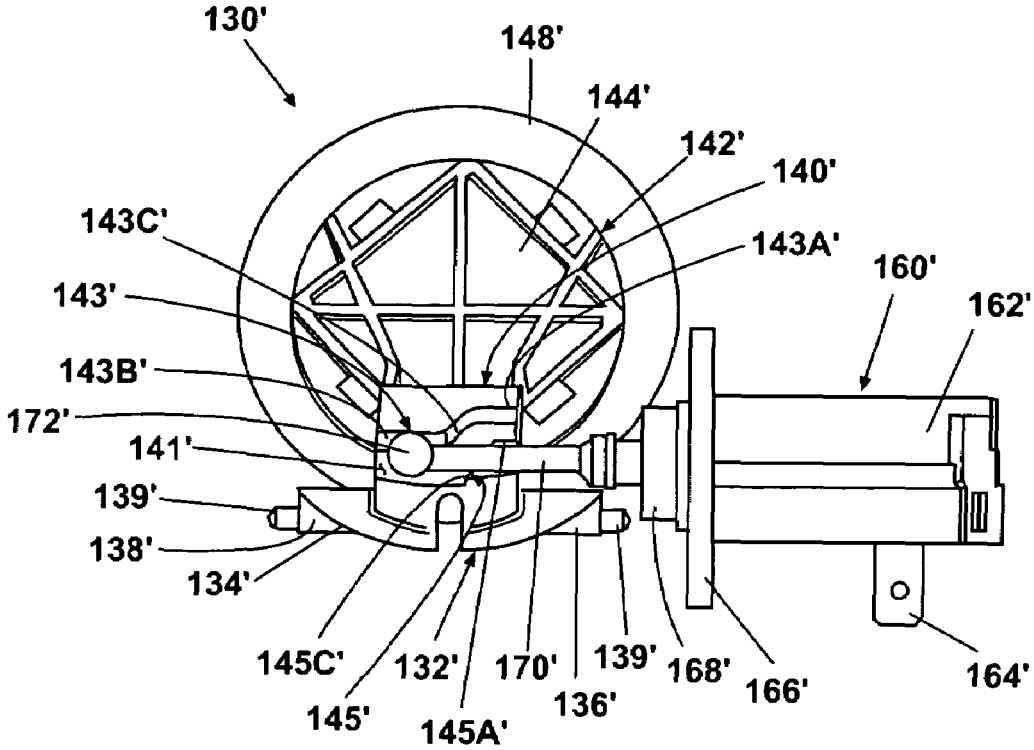
FIG. 18 is rear view similar to FIG. 15 with the actuator is in an active position.
Figure 18A:
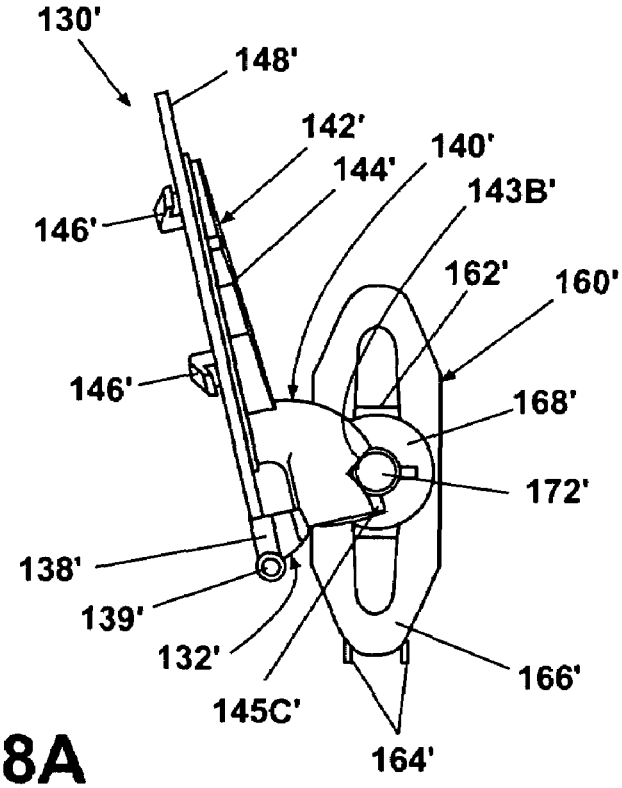
FIG. 18A is a side view of the valve and actuator of FIG. 18.

When the control system 17 sends a signal to the actuator 160' to move the valve 130' to the closed position, such as during a wash cycle, the shaft 170' extends away from the motor body 162' to move to the active position, as shown in FIGS. 18 and 18A. As the shaft 170' extends away from the motor body 162', the terminal ball 172' rides along the first cam surface 173'. When the terminal ball 172' rides along the diagonal section 173C', the actuator 160' forces the hinge 134' to rotate about the pivot axis X'. As the hinge 132' rotates, the valve body support 142' and the valve body 148' pivot about the pivot axis X' and towards the inlet 100' until the valve 130' reaches the closed position, wherein the valve body 148' abuts the bezel 115' to seal the exhaust flow path 41' at the inlet 100'. Additionally, because the modular exhaust vent 10' is positioned directly adjacent the interior wall 15 and the opening 19 in the door 18 and the valve body 148 selectively closes the inlet 100, the upstream space between the wash chamber 16 and the inlet 100' is eliminated, which reduces the transmission of noise to the exterior of the dishwasher 12 even when the valve 130' is in the closed position. When the shaft 170' is fully extended, the terminal ball 172' is adjacent the second horizontal section 143B', and interaction between the second horizontal section 143B' and the terminal ball 172' holds the valve 130' in the closed position.

When the control system 17 terminates the signal sent to the actuator 160', such as during a dry cycle, the shaft 170' retracts into the motor body 162' to the inactive position. As the shaft 170' retracts, the terminal ball 172' rides along the second cam surface 145'. When the terminal ball 172' rides along the diagonal section 145C', the actuator 160' rotates the hinge 134' in an opposite direction to pivot the valve body support 142' and the valve body 148' about the pivot axis X' and away from the inlet 100' until the terminal ball 172' is adjacent the horizontal section 145A' and the valve 130' reaches the opened position, wherein the valve body 148' is spaced from the bezel 115' to open the exhaust flow path 41'.

As described above, a major difference between the alternative embodiment modular exhaust valve 10' and the first embodiment exhaust valve 10 is that manner in which the actuator 160 communicates with the valve 130 for opening and closing the valve. In the former, the actuator 160' is directly coupled to the valve 130' to move the valve between the opened and closed positions. Conversely, in the latter, the link 150 couples the actuator to the valve 130 to transfer movement of the actuator between the inactive and active positions into movement of the valve 130 between the opened and closed positions.

While the invention has been specifically described in connection with certain specific embodiments thereof, it is to be understood that this is by way of illustration and not of limitation, and the scope of the appended claims should be construed as broadly as the prior art will permit.

What is claimed is:

1. A dishwasher comprising:

an open-face cabinet defining a wash chamber;

a door movably mounted to the cabinet for movement between an opened condition and a closed condition to selectively close the open-face cabinet and comprising an interior wall that faces the wash chamber when the door is in the closed condition; and a modular exhaust vent comprising:

a housing mounted to the door and defining a conduit having an inlet coincident with the interior wall and an outlet, the inlet opening to the wash chamber, and the outlet opening to the exterior of dishwasher to form an exhaust flow path from the wash chamber to the exterior of the dishwasher; and a valve located at the inlet and carried by the housing and operable between an opened position, where the valve is spaced from the inlet, and a closed position, where the valve closes the inlet to impede introduction of sound into the conduit.

2. The dishwasher according to claim 1, wherein the valve is normally biased to the opened position.

3. The dishwasher according to claim 1, wherein the door comprises an opening in the interior wall, so that the valve in the closed position is adjacent to the opening of the interior wall.

4. The dishwasher according to claim 1, wherein the conduit comprises a valve seat at the inlet, and the valve comprises a valve body that abuts the valve seat when the valve is in the closed position.

5. The dishwasher according to claim 4, wherein the modular exhaust vent further comprises an inlet cover that overlies the inlet and forms the valve seat.

6. The dishwasher according to claim 5, wherein the inlet cover comprises a bezel that forms the valve seat.

7. The dishwasher according to claim 5, wherein at least a portion of the inlet cover overlies the interior wall.

8. The dishwasher according to claim 5, wherein the valve body is a resilient disk.

9. The dishwasher according to claim 5, wherein at least a portion of the inlet cover projects into the conduit so that the valve seat resides in the conduit near the inlet.

10. The dishwasher according to claim 1, wherein the valve is operable for pivotal movement about a pivot axis between the opened and the closed positions.

11. The dishwasher according to claim 10, wherein the modular exhaust vent further comprises:

an actuator; and a link connecting the actuator to the valve;

wherein activation of the actuator effects movement of the link to move the valve to one of the opened and closed positions.

12. The dishwasher according to claim 11, wherein the valve is carried by a frame having a hinge that defines the pivot axis.

13. The dishwasher according to claim 12, wherein the link comprises a lever arm having a longitudinal axis transverse to the pivot axis.

14. The dishwasher according to claim 13, wherein the hinge is coupled to the lever arm.

15. The dishwasher according to claim 14, wherein the actuator comprises a shaft operably mounted to the lever arm and movable between an inactive position and an active position for pivoting the lever arm about the pivot axis and moving the valve between the opened and closed positions.

16. In a dishwasher comprising an open-face cabinet defining a wash chamber; and a door movably mounted to the cabinet for movement between an opened condition and a closed condition to selectively close the open-face cabinet and comprising an interior wall that faces the wash chamber when the door is in the closed condition; a modular exhaust vent comprising:

a housing mounted to the door and defining a conduit having an inlet coincident with the interior wall and an outlet, the inlet opening to the wash chamber, and the outlet opening to the exterior of dishwasher to form an exhaust flow path from the wash chamber to the exterior of the dishwasher; and a valve located at the inlet and carried by the housing and operable between an opened position, where the valve is spaced from the inlet, and a closed position, where the valve closes the inlet to impede introduction of sound into the conduit.

17. The modular exhaust vent according to claim 16, wherein the valve is normally biased to the opened position.

18. The modular exhaust vent according to claim 16, wherein the door comprises an opening in the interior wall, so that the valve in the closed position is adjacent to the opening.

19. The modular exhaust vent according to claim 16, wherein the conduit comprises a valve seat at the inlet, and the valve comprises a valve body that abuts the valve seat when the valve is in the closed position.

20. The modular exhaust vent according to claim 19 and further comprising an inlet cover that overlies the inlet and forms the valve seat.

21. The modular exhaust vent according to claim 20, wherein the inlet cover comprises a bezel that forms the valve seat.

22. The modular exhaust vent according to claim 20, wherein at least a portion of the inlet cover overlies the interior wall.

23. The modular exhaust vent according to claim 20, wherein the valve body is a resilient disk.

24. The modular exhaust vent according to claim 20, wherein at least a portion of the inlet cover projects into the conduit so that the valve seat resides in the conduit near the inlet.

25. The modular exhaust vent according to claim 16, wherein the valve is operable for pivotal movement about a pivot axis between the opened and the closed positions.

26. The modular exhaust vent according to claim 25 and further comprising:

an actuator; and a link connecting the actuator to the valve;

wherein activation of the actuator effects movement of the link to move the valve to one of the opened and closed positions.

27. The modular exhaust vent according to claim 26, wherein the valve is carried by a frame having a hinge that defines the pivot axis.

28. The modular exhaust vent according to claim 27, wherein the link comprises a lever arm having a longitudinal axis transverse to the pivot axis.

29. The dishwasher according to claim 28, wherein the hinge is coupled to the lever arm.

30. The dishwasher according to claim 29, wherein the actuator comprises a shaft operably mounted to the lever arm and movable between an inactive position and an active position for pivoting the lever arm about the pivot axis and moving the valve between the opened and closed positions.

31. A dishwasher comprising:

an open-face cabinet defining a wash chamber;

a door movably mounted to the cabinet for movement between an opened condition and a closed condition to selectively close the open-face cabinet and comprising an interior wall that faces the wash chamber when the door is in the closed condition and an exterior wall opposite the interior wall and defining a door interior therebetween; and a modular exhaust vent comprising:

a housing located within the door interior and defining a conduit extending between the interior wall and the exterior wall, with an inlet at the interior wall and an outlet at the exterior wall, the inlet opening to the wash chamber, and the outlet opening to the exterior of dishwasher to form an exhaust flow path from the wash chamber to the exterior of the dishwasher; and a valve carried by the housing and operable between an opened position, where the valve is spaced from the inlet, and a closed position, where the valve closes the inlet at the interior wall to impede introduction of sound into the conduit.

32. A dishwasher comprising:

an open-face cabinet defining a wash chamber;

a door movably mounted to the cabinet for movement between an opened condition and a closed condition to selectively close the open-face cabinet and comprising an interior wall that faces the wash chamber when the door is in the closed condition and an exterior wall opposite the interior wall and defining a door interior therebetween; and a modular exhaust vent comprising:

a housing located within the door interior and defining a conduit extending between the interior wall and the exterior wall, with an inlet coincident with the interior wall and opening to the wash chamber and an outlet coincident with the exterior wall and opening to the exterior of dishwasher to form an exhaust flow path from the wash chamber to the exterior of the dishwasher; and a valve carried by the housing and operable between an opened position, where the valve is spaced from the inlet, and a closed position, where the valve closes the inlet at the interior wall to impede introduction of sound into the conduit.

* * * * *